US006247803B1

(12) United States Patent
Kanaya et al.

(10) Patent No.: US 6,247,803 B1
(45) **Date of Patent: *Jun. 19, 2001**

(54) INK JET RECORDING APPARATUS AND METHOD FOR REPLENISHING INK IN THE TANK CARTRIDGE

(75) Inventors: Munehide Kanaya; Takao Kobayashi; Kiyofumi Usui; Eiko Yanagida; Yoshinori Miyazawa, all of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/474,296

(22) Filed: Jun. 7, 1995

Related U.S. Application Data

(63) Continuation-in-part of application No. 08/357,639, filed on Dec. 16, 1994, now abandoned, which is a continuation-in-part of application No. 08/150,676, filed on Nov. 10, 1993, now Pat. No. 5,421,658, which is a continuation of application No. 07/962,959, filed on Oct. 16, 1992, now Pat. No. 5,328,279, which is a continuation of application No. 07/612,010, filed on Nov. 9, 1990, now Pat. No. 5,156,471, which is a continuation of application No. 07/401,539, filed on Aug. 31, 1989, now Pat. No. 4,969,759, which is a continuation of application No. 07/161,216, filed on Feb. 17, 1988, now abandoned, which is a continuation of application No. 07/035,251, filed on Mar. 23, 1987, now abandoned, which is a continuation of application No. 06/873,871, filed on Jun. 12, 1986, now abandoned, which is a continuation of application No. 06/659,816, filed on Oct. 11, 1984, now abandoned.

(30) Foreign Application Priority Data

| | | |
|---|---|---|
| Oct. 13, 1983 | (JP) | 58-191529 |
| Nov. 29, 1983 | (JP) | 58-224892 |
| May 22, 1984 | (JP) | 59-102841 |
| May 22, 1984 | (JP) | 59-102842 |
| May 22, 1984 | (JP) | 59-102843 |
| Apr. 21, 1995 | (JP) | 7-118974 |

(51) Int. Cl.[7] ..... B41J 2/175
(52) U.S. Cl. ..... 347/86
(58) Field of Search ..... 347/86, 87, 85; 206/701; 604/117

(56) References Cited

U.S. PATENT DOCUMENTS 608,887 8/1898 Melven .

(List continued on next page.)

FOREIGN PATENT DOCUMENTS 2546835 4/1977 (DE) .

(List continued on next page.)

OTHER PUBLICATIONS

Erturk et al, Ink Retention in a Color Thermal Inkjet Pen, Hewlett–Packard Journal, Aug. 1988, pp. 41–44.*

(List continued on next page.)

*Primary Examiner*—Richard Moses
(74) *Attorney, Agent, or Firm*—Stroock & Stroock & Lavan LLP

(57) ABSTRACT

An ink tank cartridge for an ink-jet type recording apparatus being removably mountable onto an ink supply needle of said ink jet type recording apparatus is provided. The ink tank cartridge comprises a first chamber for storing ink and a second chamber for storing a porous member. A partition wall separates the first chamber from the second chamber. A lid is attached to the top of the cartridge and at least a portion of the lid corresponding to at least one of the chambers may be opened to allow for replenishment of ink in the ink tank cartridge. Alternatively, the lid may be permanently fixed to the top on the ink tank cartridge, and an ink replenishment hole may be formed in the lid to allow for replenishment with an ink injection device. The ink tank may also be replenished by placing a self contained ink replenishment pack into said ink tank cartridge.

3 Claims, 22 Drawing Sheets

U.S. PATENT DOCUMENTS

| | | | | |
|---|---|---|---|---|
| 1,321,785 | | 11/1919 | Bronner . | |
| 1,569,470 | | 1/1926 | Falder . | |
| 2,585,647 | | 2/1952 | Gordon | 118/265 |
| 2,688,307 | | 9/1954 | Nichols et al. . | |
| 2,747,543 | | 5/1956 | Navikas | 118/264 |
| 3,018,756 | | 1/1962 | Kilham | 118/264 |
| 3,094,124 | * | 6/1963 | Birtwell . | |
| 3,097,597 | | 7/1963 | Visser | 101/364 |
| 3,101,667 | | 8/1963 | Siegel | 101/364 |
| 3,441,950 | | 4/1969 | Miller | 346/140 |
| 3,483,810 | * | 12/1969 | Peters | 604/117 X |
| 3,599,566 | | 8/1971 | Fish | 101/364 |
| 3,967,286 | | 6/1976 | Andersson et al. | 346/140 |
| 4,017,871 | | 4/1977 | Hubbard | 346/140 |
| 4,095,237 | | 6/1978 | Amberntsson et al. | 346/140 |
| 4,183,030 | | 1/1980 | Kaieda et al. | 346/140 |
| 4,183,031 | | 1/1980 | Kyser et al. | 346/140 R |
| 4,194,846 | | 3/1980 | Zerillo | 400/124 |
| 4,272,773 | | 6/1981 | Halasz | 346/140 |
| 4,279,519 | | 7/1981 | Shiurila | 400/124 |
| 4,306,245 | * | 12/1981 | Kasugayama | 347/87 X |
| 4,336,767 | | 6/1982 | Wada | 118/264 |
| 4,353,654 | | 10/1982 | Shiurila | 400/124 |
| 4,368,478 | | 1/1983 | Koto | 346/140 |
| 4,400,102 | | 8/1983 | Shiurila et al. | 400/124 |
| 4,403,874 | | 9/1983 | Payne et al. | 400/124 |
| 4,419,677 | * | 12/1983 | Kasugayama et al. | 347/87 |
| 4,419,678 | * | 12/1983 | Kasugayama | 347/86 |
| 4,429,320 | * | 1/1984 | Hattori | 347/86 |
| 4,436,439 | | 3/1984 | Koto . | |
| 4,456,393 | | 6/1984 | Gomi et al. | 400/124 |
| 4,463,362 | | 7/1984 | Thomas | 347/86 |
| 4,484,827 | | 11/1984 | Price, Jr. | 401/205 |
| 4,500,222 | | 2/1985 | Clading-Boel . | |
| 4,506,277 | | 3/1985 | Terasawa | 346/140 |
| 4,510,510 | | 4/1985 | Terasawa . | |
| 4,511,906 | | 4/1985 | Hara | 346/140 |
| 4,553,865 | | 11/1985 | Ikeda et al. | 400/124 |
| 4,589,000 | * | 5/1986 | Koto et al. | 347/68 |
| 4,620,202 | | 10/1986 | Koto et al. . | |
| 4,630,758 | | 12/1986 | Mutoh | 222/189 |
| 4,631,558 | | 12/1986 | Hara . | |
| 4,695,824 | | 9/1987 | Tazaki | 346/140 |
| 4,719,479 | | 1/1988 | Kyogoku | 346/140 |
| 4,771,295 | * | 9/1988 | Baker | 347/87 |
| 4,794,409 | | 12/1988 | Cowger et al. | 346/140 |
| 4,855,762 | | 8/1989 | Suzuki | 346/140 |
| 4,920,362 | | 4/1990 | Cowger . | |
| 4,967,207 | | 10/1990 | Ruder | 346/140 R |
| 4,968,998 | | 11/1990 | Allen | 346/140 R |
| 4,969,759 | | 11/1990 | Suzuki et al. | 400/124 |
| 5,056,433 | | 10/1991 | Murphy et al. | 101/364 |
| 5,070,346 | | 12/1991 | Mochizuki et al. | 347/86 |
| 5,119,115 | | 6/1992 | Buat et al. | 346/140 |
| 5,156,470 | | 10/1992 | Suzuki et al. | 400/124 |
| 5,156,471 | | 10/1992 | Suzuki et al. | 400/124 |
| 5,156,472 | | 10/1992 | Suzuki et al. | 400/124 |
| 5,156,473 | | 10/1992 | Suzuki et al. | 400/124 |
| 5,158,377 | | 10/1992 | Suzuki et al. | 400/124 |
| 5,174,665 | | 12/1992 | Suzuki et al. | 400/124 |
| 5,187,498 | * | 2/1993 | Burger | 347/86 |
| 5,199,470 | * | 4/1993 | Goldman | 347/85 X |
| 5,221,148 | | 6/1993 | Suzuki et al. | 400/124 |
| 5,255,019 | | 10/1993 | Mochizuki et al. | 346/140 |
| 5,262,802 | | 11/1993 | Karita et al. . | |
| 5,280,300 | | 1/1994 | Fong et al. | 346/1.1 |
| 5,289,212 | | 2/1994 | Carlotta | 346/140 |
| 5,328,279 | | 7/1994 | Suzuki et al. | 400/124 |
| 5,329,294 | * | 7/1994 | Ontawar | 347/87 |
| 5,420,625 | | 5/1995 | Dieti et al. | 347/85 |
| 5,421,658 | | 6/1995 | Suzuki et al. | 400/124 |
| 5,444,474 | | 8/1995 | Ohtsubo et al. . | |
| 5,453,771 | | 9/1995 | Waseda et al. . | |
| 5,477,963 | * | 12/1995 | Mochizuki et al. | 206/701 |
| 5,488,401 | | 1/1996 | Mochizuki et al. | 347/86 |
| 5,509,140 | * | 4/1996 | Koitabashi et al. | 347/86 |
| 5,510,820 | * | 4/1996 | Aulick et al. | 347/85 |
| 5,515,663 | * | 5/1996 | Allgeier | 347/87 X |
| 5,526,030 | | 6/1996 | Baldwin et al. . | |
| 5,552,816 | * | 9/1996 | Oda et al. | 347/86 |
| 5,560,720 | | 10/1996 | Suzuki et al. . | |
| 5,603,577 | | 2/1997 | Suzuki et al. . | |
| 5,607,242 | | 3/1997 | Suzuki et al. . | |
| 5,615,957 | | 4/1997 | Suzuki et al. . | |
| 5,622,439 | | 4/1997 | Suzuki et al. . | |
| 5,631,682 | * | 5/1997 | Takata | 347/86 |
| 5,841,455 | * | 11/1998 | Tanaka | 347/87 |

FOREIGN PATENT DOCUMENTS

| | | |
|---|---|---|
| 33 16 298 | 1/1983 | (DE) . |
| 44 11 873 | 10/1994 | (DE) . |
| 0 261 764 A1 | 3/1988 | (EP) . |
| 0 340 533 | 11/1989 | (EP) . |
| 0 398 452 | 11/1990 | (EP) . |
| 0 408 241 | 1/1991 | (EP) . |
| 0 488 829 A2 | 6/1992 | (EP) . |
| 529625 | 3/1993 | (EP) . |
| 0 536 980 A2 | 4/1993 | (EP) . |
| 542247 A2 | 5/1993 | (EP) . |
| 0 581 531 A1 | 7/1993 | (EP) . |
| 0 553 535 A1 | 8/1993 | (EP) . |
| 0 561 081 | 9/1993 | (EP) . |
| 562733 | 9/1993 | (EP) . |
| 0 567 308 | 10/1993 | (EP) . |
| 0 567 308 A2 | 10/1993 | (EP) . |
| 0 580 433 A1 | 1/1994 | (EP) . |
| 0 598 481 | 4/1994 | (EP) . |
| 605183 | 7/1994 | (EP) . |
| 605385 A2 | 7/1994 | (EP) . |
| 0 611 656 | 8/1994 | (EP) . |
| 0 624 475 A2 | 11/1994 | (EP) . |
| 0 624 475 A3 | 11/1994 | (EP) . |
| 0 625 424 A2 | 11/1994 | (EP) . |
| 0 631 874 A2 | 1/1995 | (EP) . |
| 0 633 138 | 1/1995 | (EP) . |
| 0 633 138 A2 | 1/1995 | (EP) . |
| 0640 484 A2 | 1/1995 | (EP) . |
| 0 639 462 A2 | 2/1995 | (EP) . |
| 0 640 482 A2 | 3/1995 | (EP) . |
| 0 640 484 A2 | 3/1995 | (EP) . |
| 0 640 848 | 3/1995 | (EP) . |
| 0 646 465 A2 | 4/1995 | (EP) . |
| 0 655 335 | 5/1995 | (EP) . |
| 0 665 108 A2 | 8/1995 | (EP) . |
| 0 633 138 | 9/1995 | (EP) . |
| 0 672 527 | 9/1995 | (EP) . |
| 2229320 | 12/1974 | (FR) . |
| 2269784 | 2/1994 | (GB) . |
| 2 288 148 | 10/1995 | (GB) . |
| 50-99436 | 8/1975 | (JP) . |
| 54-8951 | 1/1979 | (JP) . |
| 42874 | 3/1980 | (JP) . |
| 55-42875 | 3/1980 | (JP) . |
| 55-65560 | 5/1980 | (JP) . |
| 55-166267 | 12/1980 | (JP) . |
| 57-84867 | 5/1982 | (JP) . |
| 185168 | 11/1982 | (JP) . |
| 57-63285 | 11/1982 | (JP) . |
| 89377 | 5/1983 | (JP) . |
| 58-142861 | 8/1983 | (JP) . |
| 188670 | 11/1983 | (JP) . |

| | | | | |
|---|---|---|---|---|
| 58-166464 | | 11/1983 | (JP) . | |
| 58-199159 | | 11/1983 | (JP) . | |
| 59-21955 | | 2/1984 | (JP) . | |
| 59-26342 | | 2/1984 | (JP) . | |
| 59-41539 | | 3/1984 | (JP) . | |
| 59-59340 | | 4/1984 | (JP) . | |
| 59-68985 | | 5/1984 | (JP) . | |
| 61-022952 | | 1/1986 | (JP) . | |
| 61-22952 | | 1/1986 | (JP) . | |
| 1-180351 | * | 7/1989 | (JP) | 347/29 |
| 4-144755 | | 5/1992 | (JP) . | |
| 6-015841 | | 1/1994 | (JP) . | |
| 6-126976 | | 5/1994 | (JP) . | |
| 6-255122 | | 9/1994 | (JP) . | |
| 07137274 | | 5/1995 | (JP) . | |
| 92/20577 | | 11/1992 | (WO) . | |
| 93/23109 | * | 11/1993 | (WO) . | |
| 95/18049 | | 7/1995 | (WO) . | |

OTHER PUBLICATIONS

Nu–Kote Refill Instructions and System for RF40A/RF40AF Quick–Quick™.

Parana Ink Jet Refill Instructions and System for HP Ink Cartridge 51608A.

Renewable Resources Inc. Refilling Instructions and System for ink jet cartridges.

Nu–Kote RF50 Starter Kit Refill Instructions and System.

RF40 Starter Kit Refill Instructions for Hewlett Packard Deskjet HP512626A Cartridge.

* cited by examiner

INK JET RECORDING APPARATUS AND METHOD FOR REPLENISHING INK IN THE TANK CARTRIDGE

This is a continuation-in-part application of application Ser. No. 08/357,639 filed Dec. 16, 1994 entitled INK-SUPPLIED PRINTER HEAD AND INK CONTAINER now abandoned, which is a continuation-in-part application of application Ser. No. 08/150,676, filed Nov. 10, 1993, which issued as U.S. Pat. No. 5,421,658, which is a continuation of application Ser. No. 07/962,959, filed Oct. 16, 1992, which issued as U.S. Pat. No. 5,328,279, which is a continuation of application Ser. No. 07/612,010, filed on Nov. 9, 1990, which issued as U.S. Pat. No. 5,156,471, which is a continuation of application Ser. No. 07/401,539, filed on Aug. 31, 1989, which issued as U.S. Pat. No. 4,969,759, which is a continuation of application Ser. No. 07/161,216, filed on Feb. 17, 1988, now abandoned, which is a continuation of application Ser. No. 07/035,251, filed on Mar. 23, 1987, now abandoned, which is a continuation of application Ser. No. 06/873,871, filed on Jun. 12, 1986, now abandoned, which is a continuation of application Ser. No. 06/659,816, filed Oct. 11, 1984, now abandoned.

BACKGROUND OF THE INVENTION

The present invention relates generally to an ink-supplied printer head being supplied with ink from an ink supply tank and more particularly to an ink supply tank which allows for the continuous supply of ink to the printer head while avoiding adverse effects from temperature, atmospheric changes or vibrations. The present invention allows for a larger volume of ink in the ink supply tank and allows for a greater percentage of the ink in the tank to be transferred to the printer head. Also, the present invention comprises a tank with transparent sides so the user is able to easily determine the remaining quantity of ink, and also means for dampening of the unwanted movement of ink within the ink supply tank.

In addition, the invention relates generally to an ink tank cartridge for an ink jet printer, and more particularly, to a replenishable ink tank cartridge which supplies ink to a recording head of an ink jet recording apparatus or the like, a replenishment pack, a replenishment tool, an ink injection device, a replenishment set, and a method of replenishing an ink tank with ink.

Ink supply systems for a wire dot matrix printer are known in which no ink ribbon is used, but ink is supplied from an ink tank to the distal ends of the wire and transferred from the wires directly to a sheet of print paper. Portions of these ink supply systems, including the supply tanks thereof, are also adaptable to be used in ink jet type printers.

In the parent applications to this application, improved ink storage and delivery was achieved by providing a porous member in an ink tank that essentially filled the tank and carried essentially the entire supply of ink. It was found that while this construction offered substantial improvement over the prior art, the use of the full porous member limited the quantity of ink which would be stored in an ink tank of a given size, increasing the frequency of ink tank replacement.

Various kinds of ink tanks for ink jet printers are known from the prior art. For example, Japanese Patent Publication (Kokai) No. SHO63-87,242 discloses an ink tank in which ink absorbing members made of a porous material are respectively housed in a plurality of chambers. Japanese Patent Publication (Kokai) No. HEI6-40,043 discloses an ink tank in which a sealed container is divided by a partition so that a chamber housing an ink absorbing member, and an ink chamber storing only ink are juxtaposed.

In the ink tanks of above-mentioned prior art examples, the ink tanks can store a large quantity of ink so that ink may be supplied to a recording head for a long print head life. When the previously charged ink is consumed, however, such an ink tank must be replaced with a fresh one. Replacement of the cartridge is cumbersome and has the additional disadvantage that the replacement process may cause the user's hands or the like to be soiled with ink. Furthermore, the disposal of depleted ink tanks involves large costs and causes environmental pollution.

Accordingly, it is desired provide an ink tank cartridge for an ink jet printer which may be reused, refilled quickly and cleanly upon depletion of ink from the ink tank and which overcomes the other limitations of the prior art.

SUMMARY OF THE INVENTION

Generally speaking, in accordance with the present invention, there is provided an ink-supplied printer head. Ink is supplied to the printer head by an ink supply system, including an ink tank having an ink supply port and a pair of side walls. An ink absorbing member is contained therein adjacent the ink supply port which occupies less than the total volume of the ink tank. A plurality of support members extend within the ink tank between the opposed side walls, positioned to locate the ink absorbing member against the ink supply port and for dampening movement of the ink in the portion of the ink supply tank not occupied by the ink absorbing member. The walls of the ink supply tank may be transparent so the user can more easily determine the amount of ink remaining in the ink supply tank.

An ink receiving and transferring member terminating in an ink port may extend into the ink tank, in which case the ink absorbing member abuts and is locally compressed by the ink receiving and transmitting member. The ink receiving and transmitting member has a capillary ink path communicating with the printer head and is supplied with ink from the ink absorbing member.

In addition, generally speaking, in accordance with the invention, an ink tank for an ink jet printer which may be refilled quickly and cleanly, and thereafter be reused by the user and a method for refilling the tank is provided. The ink tank is constructed with its interior divided by one or more partitions into a plurality of chambers where at least one of these chambers houses an ink absorbing member. The ink tank is also formed with a lid, a portion of which may be opened at least above the chambers the ink absorbing member.

In another embodiment, an ink supply hole is formed in the lid of the tank to allow for refill of the tank through the use of an ink injection device. In a preferred embodiment the partition detachably attaches to the container.

An ink replenishment pack houses an ink absorbing member, the ink absorbing member absorbing ink and being in a compressed state within the pack. The pack includes at least a top wall and bottom wall and has a first through hole formed in the top wall and second through hole formed in the bottom wall. A respective replenishment pack may contain an absorbing member of different color ink than another replenishment pack, the replenishment pack being detachably attached within a chamber. The ink absorbing member has a larger volume than the capacity of the chamber.

At least one of the chambers within the container does not house an ink absorbing member. A openable replenishment hole is formed in the lid in a portion corresponding to the empty chamber. An ink supply port member having a through hole is disposed at the bottom of the chamber and protrudes into the chamber housing the ink absorbing member. The ink absorbing member is resiliently pressed by the ink supply port member to partially increase the compressibility of a portion of the absorbing member in the vicinity of an ink supply port. A projection extends from the lid and presses the ink absorbing member toward the ink supply port.

An ink injection device has a container for holding ink to be injected into an ink tank. The container allows for visible observation of the ink. A scale indicative of a quantity of consumed ink is formed on the container portion. A needle is coupled to the container. A scale indicating penetration depth of the needle is formed on the needle. The ink jet injection device, when combined with a replenishment pack or ink absorbing member, forms an ink replenishment set for recording apparatus.

The ink cartridge is replenished by opening the lid and removing the ink absorbing member. The container is rotated so that the ink absorbing member containing chamber is positioned above a second chamber. An ink absorbing member is loaded in the first chamber and ink is supplied to the ink absorbing member. The lid uses the ink injection device and the first chamber is then closed.

In a preferred embodiment there may be a plurality of chambers having ink absorbing members and the ink absorbing members have a larger volume than the capacity of the chamber.

In a preferred embodiment, the supply needle of the replenishment tool is passed through an air vent hole of the lid of a first chamber of an ink tank, the ink tank having a plurality of chambers divided by a partition and the chambers partially communicate with each other via a communicating hole. The needle of the ink injection device pierces the ink absorbing member, a releasable seal is removed to open an air supply hole, the ink absorbing member being replenished with the ink from the chamber. The empty chamber, without the absorption member, may also be replenished by the injection device through a replenishment formed in the lid above the empty chamber.

In another embodiment, the partition forming the chambers is removed and an ink absorbing member is then loaded therein.

Accordingly, it is an object of the invention to provide an improved ink cartridge for an ink jet printer.

It is an object of the present invention to provide a high-quality and highly reliable ink-supplied printer head of a simple construction which is capable of supplying a stable and appropriate quantity of ink from an ink tank to the printer head and. is less subject to the influence of environmental changes such as temperature or atmospheric variations.

Accordingly, it is another object of the invention to provide an improved ink tank for an ink jet printer.

It is another object of the invention to provide a system having an ink tank which can be refilled, prolonging the life of the ink tank.

Yet another object of the invention is to prevent the environment from being polluted by providing a replenishable ink tank.

Another object of the invention is to provide an ink tank in which only the chamber housing an ink absorbing member can be opened, and the ink absorbing member and other chambers in the tank can be replenished with ink.

A further object of the invention to provide an ink tank in which a plurality of chambers of the ink tank respectively house ink absorbing members and the ink absorbing members can be replenished with ink.

A still further object of the invention is to provide an ink tank in which a partition of the ink tank is detachably and slidably attached so that the quantity of absorbed ink contained therein can be adjusted.

Yet another object of the invention is to provide an ink tank in which an ink absorbing member is loaded in a compressed state.

A further object of the invention is to provide an ink tank in which an ink absorbing member is loaded in a compressed state.

Still another object of the invention is to provide a replenishment pack in which an ink absorbing member is housed in a storage unit and the ink absorbing member can be used to replenish a depleted ink absorbing member in a clean manner.

Yet a further object of the invention is to provide a replenishment tool for an ink tank which can separately replenish a plurality of chambers of the ink tank.

Still a further object of the invention is to provide a replenishment set which comprises a set of ink injection devices and, an ink absorbing member.

Yet another object of the invention is to provide a method for replenishing a plurality of chambers within an ink tank.

Still other objects, features and advantages of the present invention will become more apparent from the following description when taken in conjunction with the accompanying drawings in which preferred embodiments of the present invention are shown by way of illustrative example and not in a limiting sense.

The invention accordingly comprises the several steps and relation of one or more of such steps with respect to each of the others, and the apparatus embodying features of construction, combinations of elements and arrangement of parts which are adopted to effect such steps, all as exemplified in the following detailed disclosure, and the scope of the invention will be indicated in the claims.

BRIEF DESCRIPTION OF THE DRAWINGS

For a full understanding of the invention, reference is had to the following description taken in connection with the accompanying drawings, in which.

DESCRIPTION OF THE PREFERRED EMBODIMENTS

A printer head according to the present invention may be used in four-color printer plotter or color image printer and has four-color ink systems and wires or ink jets corresponding respectively to four ink colors. The four-color printer plotter employs black, red, green and blue inks, and moves the head or a sheet of print paper or both and then projects a wire, or ejects ink without the use of a projecting wire as in a conventional ink jet print head, corresponding to a desired one of the colors against the print paper at a prescribed position thereon to form an ink dot. Desired characters and figures can thus be recorded by repeating the above cycle. The present invention is applicable to ink jet printers of all varieties, including print heads using heat from heated resistors or the like or the displacement of piezoelectric or with transducers to project a drop of ink from a chamber upon application of a print signal. The ink supply tanks according to the invention can supply ink continuously to said chambers through capillary paths.

In a color image printer using inks of four colors, that is, black, red, green and blue, a sheet of print paper is scanned by a printer head in a direction perpendicular to the direction of feed of the print paper to form one-dot line in one scanning stroke, and the print paper is fed along by line pitches to record images. In seven-color printers, inks of four colors, that is, black, yellow, magenta and cyan, are used, and the colors of red, green and blue are formed on a sheet of print paper by superimposing inks of two out of the three desired colors other than black, thereby recording color images of seven colors.

The present invention is concerned primarily with the printer head, and in particular with the ink tanks, and detailed description of the overall printer construction will be given only by way of a single example.

Figure 1:
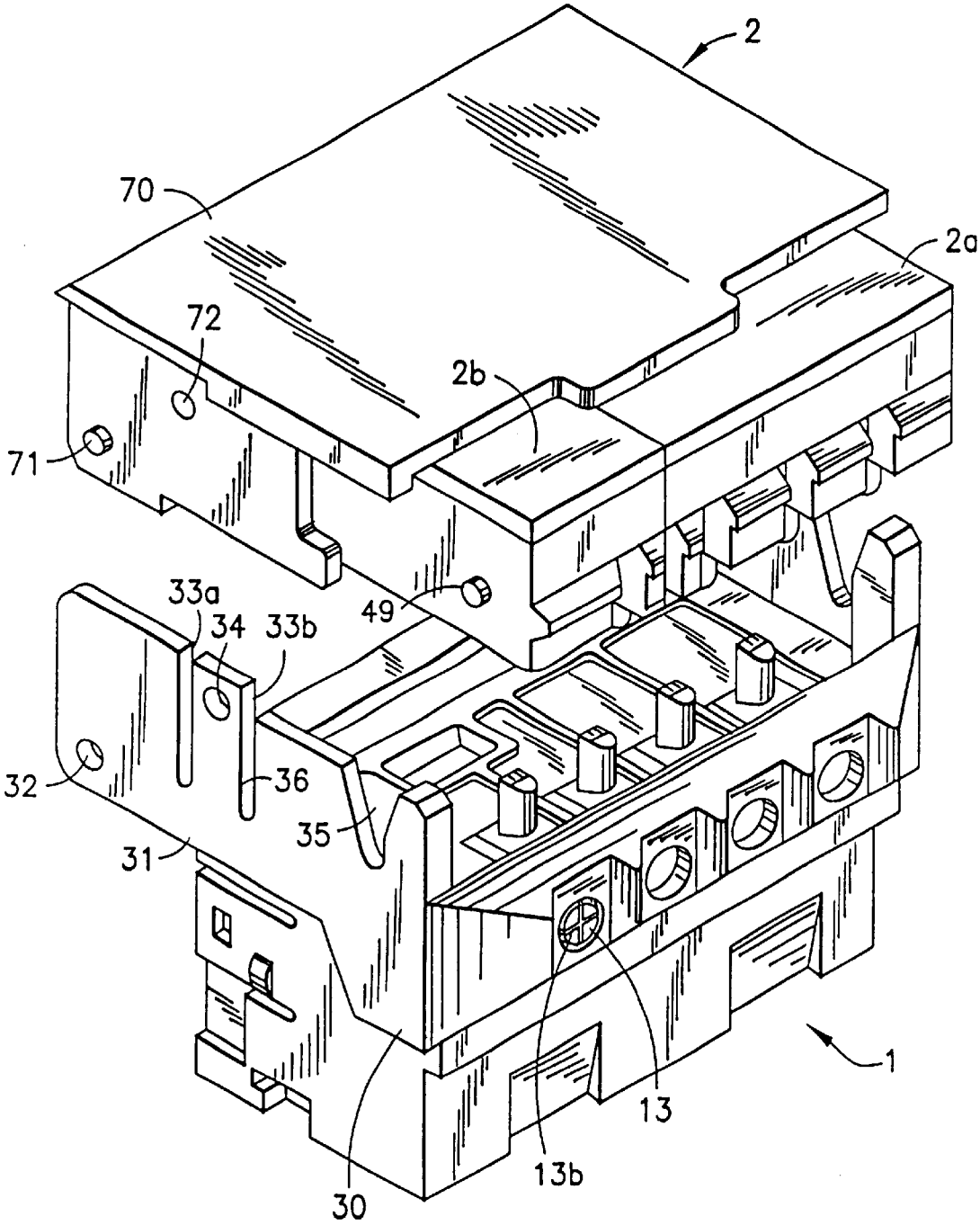
FIG. 1 is an exploded perspective view of a wire dot printer head according to an embodiment of the present invention.
Figure 2:
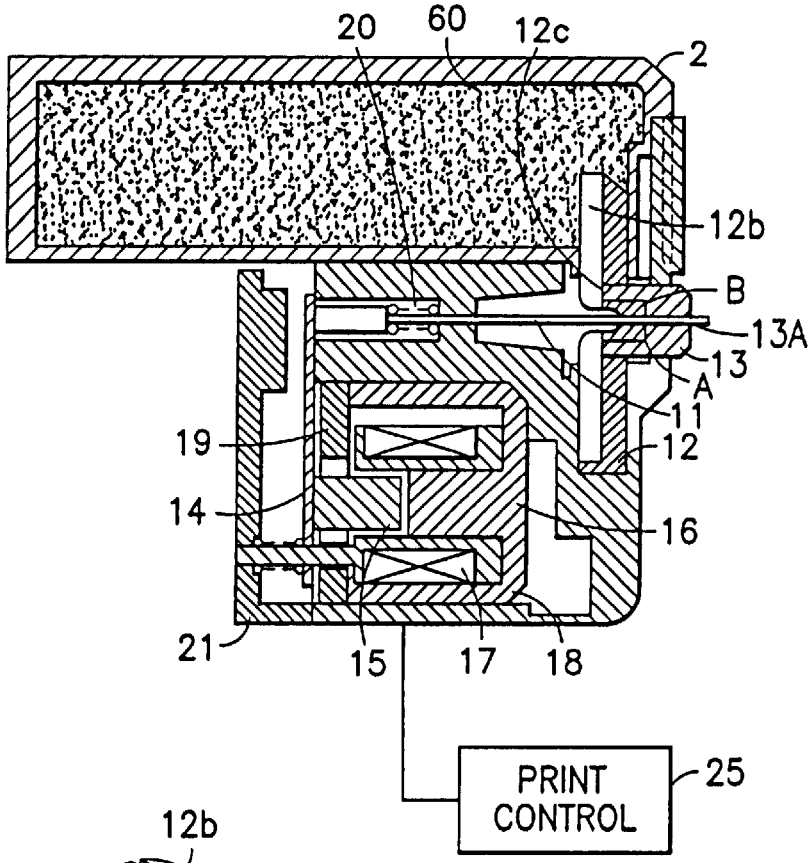
FIG. 2 is a vertical cross-sectional view of the printer head shown in FIG. 1.

FIG. 1 is an exploded perspective view of a printer head, and FIG. 2 is a vertical cross-sectional view of the printer head constructed in accordance with the invention. An ink tank, shown generally as 2, is detachably mounted by a holder 70 on top of a printer head body 1. The ink tank 2 is of a double construction composed of a first ink tank 2*b* for holding black ink and a second ink tank 2*a* which is divided into three sections for color inks. The inks are impregnated in ink-impregnated members 60 of a porous material which are enclosed in the ink tank 2.

Figure 18:
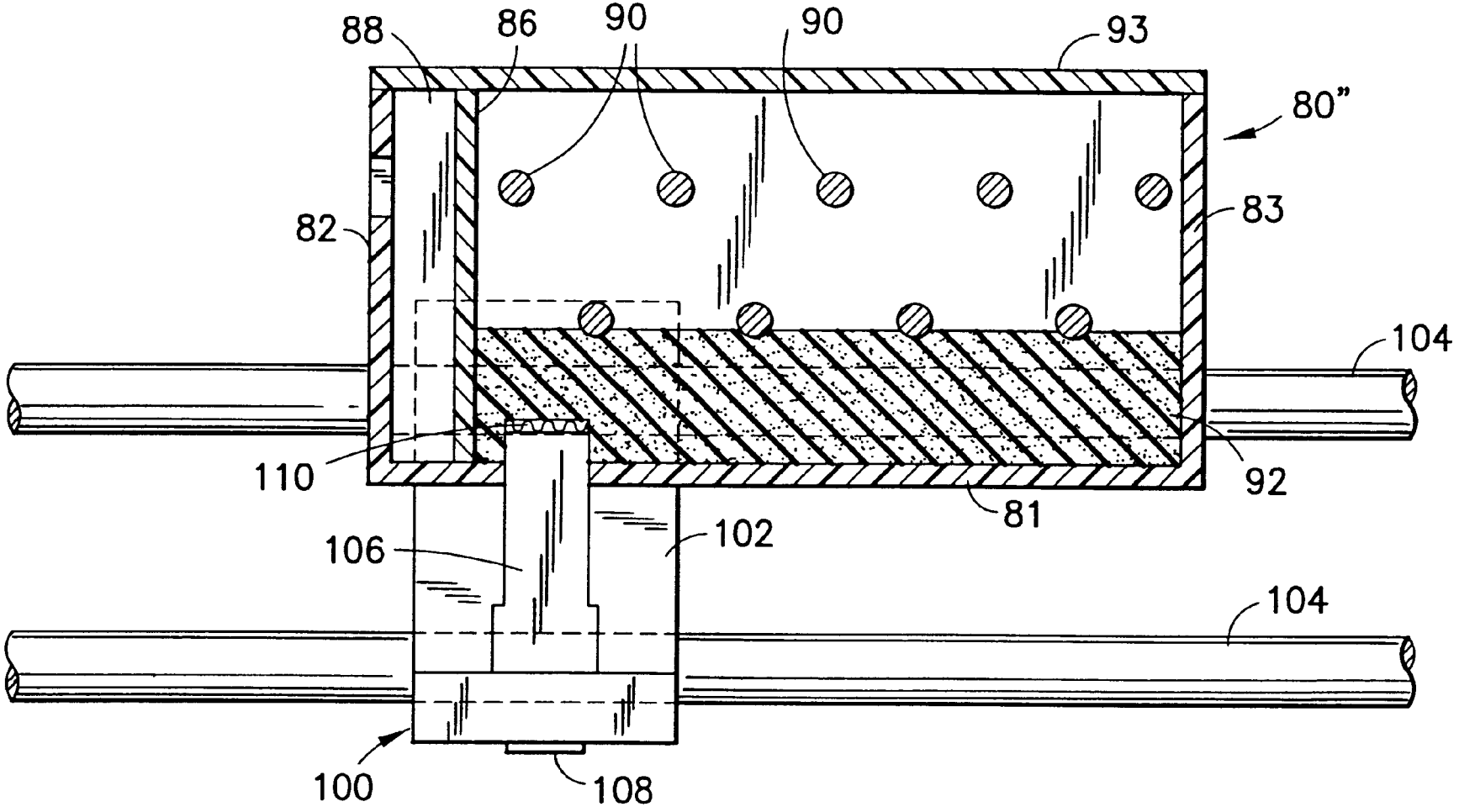
FIG. 18 is a side elevational view of an ink jet type printer of the present invention with the ink supply tank in cross section.

For each ink, the printer head body 1 has in its front portion an ink supply guide 12, shown in FIG. 2, having ink guide slot 12*b* with ends leading to the ink-impregnated member 60 and a wire guide 13 having a wire guide hole 13*a* in which a wire 11 is partly disposed or to a mechanism for ejecting the ink as in a conventional ink jet printer as is shown in FIG. 18. The ink supply guide 12 and the wire guide 13 or ink ejecting mechanism 105 jointly form an ink path from the ink tank 2 to the distal or tip end of the wire 11 in FIG. 2, or the ink ejecting orifice 207 as is shown in FIG. 18. The illustrated printer head is constructed for use in a four-color printer plotter or a four-color image printer, and there are employed four wires corresponding respectively to the four colors. Alternatively, the ink can be supplied to four independent ink ejecting mechanisms which would allow four color printing as in a conventional four color ink jet type printer.

In the wire dot matrix embodiment, a wire driver unit for each wire 11 includes a magnetic circuit comprising a yoke 18 having a coil core 16 around which a coil 17 is wound, a yoke plate 19, and a plunger 15. Coil 17 is energized by a signal from print control 25, shown schematically in FIG. 2, permitting control over the time and sequence of the driving of each wire 11. Movement of the plunger 15 is transmitted through a clapper 14 to the wire 11. The wire driver unit is covered with a cover 21 which limits the stroke of the clapper 14. In a standby position, the tip end of the wire is located back from a distal end surface of the wire guide 13, and the wire length is selected such that an ink meniscus formed in a front portion of the wire guide hole 13a covers the tip end of the wire.

Figure 3:
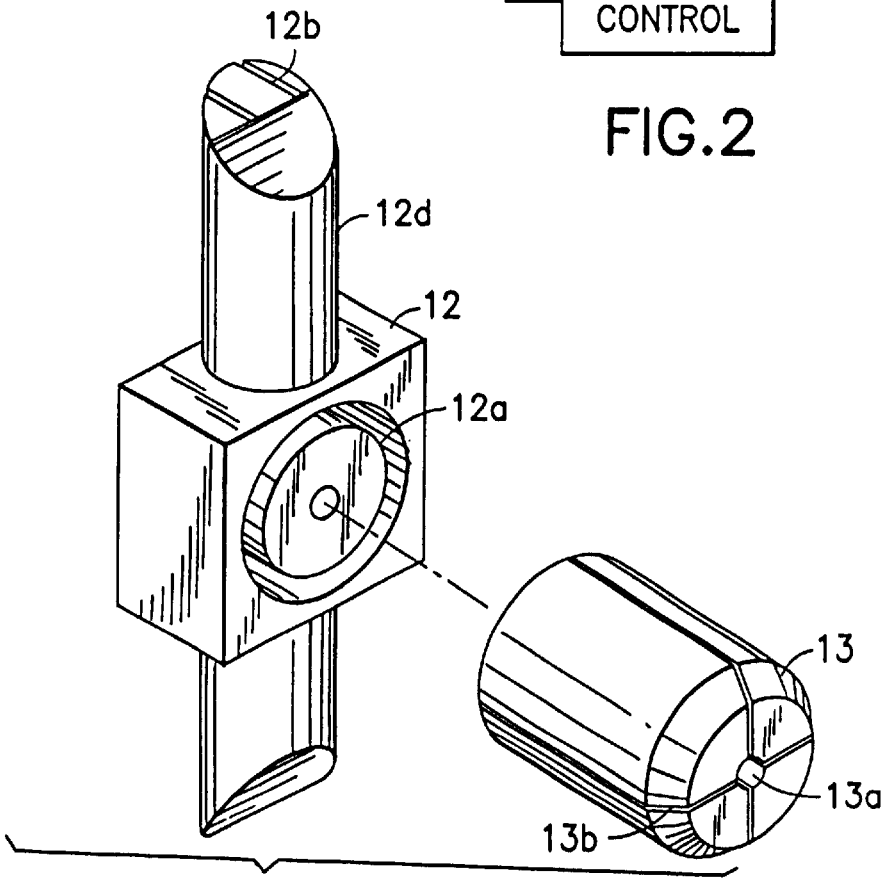
FIG. 3 is an exploded perspective view of an ink guide for use with a wire dot printer according to the present invention.

An ink guide assembly for the wire dot matrix printer, which comprises the ink supply guide 12 and the wire guide will be described in greater detail with reference to FIG. 3.

The ink supply guide 12 has axial ink guide slot 12*b* leading to the ink-impregnated member 60. The ink guide slot 12*b* has a diameter selected such that ink will be supplied continuously from the ink tank 2 as described later on. In the wire dot printer embodiment the ink guide slot 12*b* has an end of wire guide 13 placed below ink guide slot 12*b*. The ink supply guide 12 has on a front surface a circular groove 12*a* connected to the ink guide grooves 12*b* through an inner portion 12*c* (FIG. 2). An end of wire guide 13 is placed in the circular groove 12*a*, defining gaps indicated at A, B (FIG. 2). There is only a small gap between the wire 11 and the peripheral surface defining the wire guide hole 13*a* in the wire guide 13. The ink is guided by capillary action from the ink tank 2 through the ink guide grooves 12*b* in the ink supply guide 12, and then through the gaps A, B between the ink supply guide 12 and the wire guide 13 to the tip end of the wire 11.

Any excessive ink on the front surface of the wire guide 13 is drawn under capillary attraction into cross-sectionally V-shaped collection grooves 13*b* defined in the front and side surfaces of the wire guide 13 and returned into the tank supply guide 12 without smearing the print paper.

The ink tank 2 will now be described in detail with reference to FIG. 4.

The ink tank 2, or each ink tank 2*a*, 2*b*, comprises a tank body 40, two ink-impregnated members 61, 62 of a porous material placed in the space in the ink tank body 40, and a lid 50. Ink impregnated members are impregnated with ink under low atmospheric pressure ranging from 5 to 10 mm Hg, so that air remaining in the porous ink-impregnated members will be reduced as much as possible to increase the amount of impregnated ink. The ink tank body 40 has a bottom 40*a* including a front ink supply port 41 and a front wall air hole 42 defined in a stepped portion thereof. The ink supply guide 12 projecting from the printer head body has an arm 12*d* inserted in the ink supply port 41. The bottom 40*a* of the ink tank body has in its raised surface a plurality of slots 45*a*, 45*b*, 45*c* communicating with the ink supply port 41 in confronting relation to the ink supply slot 12*b* defined in the arm 12*d* of the ink supply guide 12. Although not shown, the slots 45*a*, 45*b* are joined together to form a single slot, which together with the slot 45*c* guides the ink into the ink supply slot 12*b*. When arm 12*d* of ink supply guide 12 is inserted in ink supply port 41, it fills the port 41 as shown in FIG. 2 and the periphery of grooves 12*b* adjacent the ink absorbing member 62 actually defines the ink supply port. The ink tank body 40 also has a side wall 40*c* having on its inner wall a plurality of vertical ridges 47 having lower ends held against the bottom 40*a* and upper ends kept out of contact with the lid 50. The ink tank body 40 further has a front partition 48 disposed behind the air hole 42 and in front of the ink supply port 41 and having one end joined to the side wall 40*c*. The tank lid 50 has on a lower surface thereof a plurality of longitudinal ridges 51.

The space or volume defined by the bottom 40*a*, the side wall 40*c*, the partition 48, and the lid 50 of the tank body 40 accommodates therein the two porous members 61, 62 as double layers. Porous members 61 and 62 are held in contact only by the raised surface 44 of the bottom 40*a*, the vertical ridges 47 of the side wall 40*c*, the partition 48, and the ridges 51 of the lid 50. Porous members 61 and 62 have different average pore sizes or diameters. The porous member 61 which has a larger average pore diameter is placed on top of the other porous member 62.

In the ink guide assembly and the ink tank thus constructed, the capillary attraction is successively greater along the ink path, that is, from the porous member 61 having the larger average pore size to the porous member 62 having a smaller average pore size, to the ink guide slots 45 defined in the raised surface of the bottom of the ink tank body, to the ink guide slot 12*b* defined in the ink supply guide arm 12*d*, to the gaps A, B between the ink supply guide 12 and the wire guide 13 and to the gap between the wire guide 13 and the wire 11 or the decreasing diameters of the spaces of the ink ejecting mechanism. The above capillary attraction path can be achieved by selecting elements having the following dimensions:

The average pore size of porous member 61: 0.4 mm

The average pore size of porous member 62: 0.3 mm

The width of the ink guide slots 45: 0.12 mm

The width of the ink guide grooves 12*b*: 0.1 mm

The gap between the ink supply guide 12 and the wire guide 13: 0.1 mm

The gap between the surface defining the wire guide hole 13*a* and the wire 11: 0.01 mm Similarly, in an ink jet type printer, successively smaller capillary paths may be used to lead the ink to the ink chamber of the print head.

A construction for removably attaching the ink tank 2 will be described with reference to FIGS. 1 and 5.

The head body 1 has a frame 30 including side walls extending from upper and back portions of the head body 1 and serving as a holder support 31. The holder support 31 has a holder support hole 32, a leaf spring 36 defined by two vertical recesses 33*a*, 33*b* and having a holder attachment hole 34, and a guide slot 35. A holder 70 has on each of its sides a cylindrical projection 71 rotatably engaging in the holder support hole 32 in the head frame 30 and a semi-spherical projection 72 engaging in the holder attachment hole 32. Each of the ink tanks 2*a*, 2*b* has a side disposed closer to the holder support 31 and having a cylindrical projection 49 engaging a lower edge of the guide slot 35.

Figure 5:
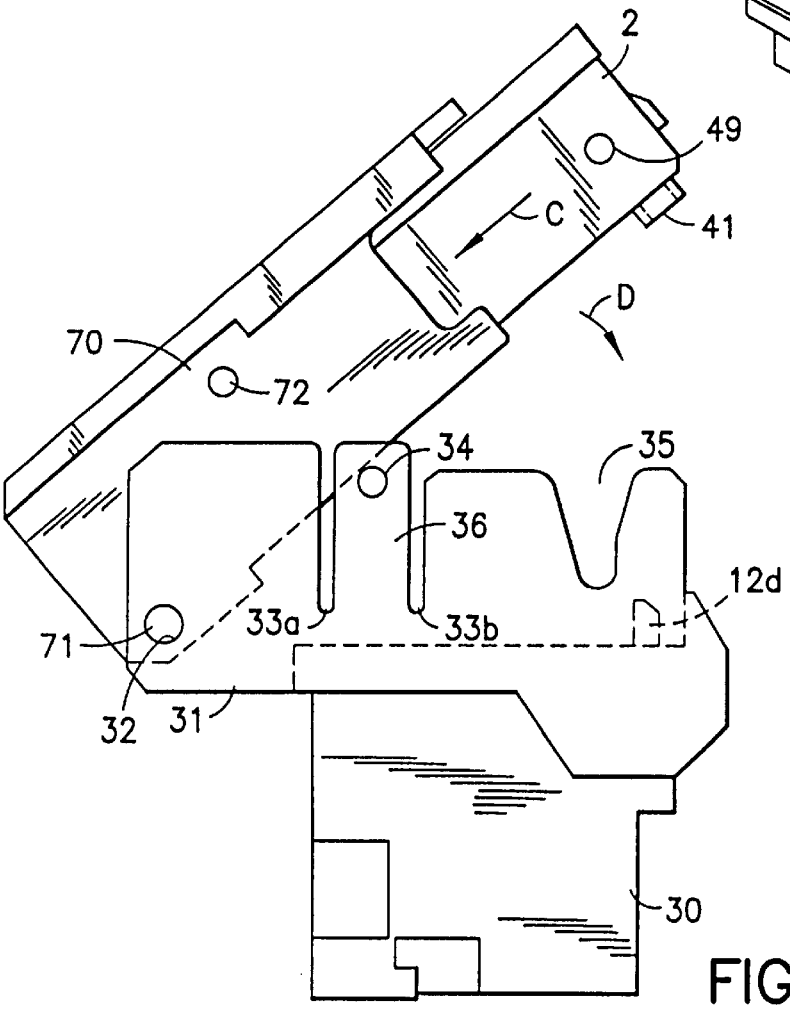
FIG. 5 is a side elevational view showing the manner in which said ink tank is mounted in place on a print head.

The ink tank can be attached and detached through the above construction in the following manner:

The holder 70 is supported in the position shown in FIG. 5, and the ink tank 2 is inserted into the holder 70 in the direction of the arrow C. At this time, the ink tank 2 is not required to be accurately positioned in the holder 70 and hence can easily be inserted into the holder 70. Then, the holder 70 is turned in the direction of the arrow D to bring the projection 49 on the side of the ink tank 2 into contact with an edge of the guide slot 35 in the head frame 30, whereupon the ink tank 2 is positioned with respect to the head frame 30. Now, the ink supply port 41 is positioned correctly above the arm 12*d* of the ink supply guide 12 projecting upwardly from the head body. Continued turning movement of the holder 70 causes the arm 12*d* to engage in the ink support port 41 and be inserted into the ink tank 2. The semispherical projection 72 on the side of the holder 70 on each side of the tank holder 70 engages and spreads the leaf springs 36 apart from each other. The semi-spherical projections 72 finally engage in the attachment holes 34 in the leaf springs 36, whereupon the leaf springs 36 return to the vertical positions to retain the holder 70 securely in position. At this time, the ink guide slots 45 on the bottom 40*a* of the ink tank 2 are disposed in confronting relation to the ink guide slot 12*b* in the arm 12*d* of the ink supply guide 12, thus forming the ink path from the ink tank to the printer head body. The ink tank 2 can be removed in a procedure which is a reversal of the above attachment process.

By way of example, the operation of the invention will now be described through an explanation of use of the ink supply tank in a wire dot matrix printer embodiment. It should be noted that an ink jet type printer head can be easily substituted for the wire dot printer head. In this case, all parts would perform similarly, the difference being that ink supply guide 12 would deliver ink to an ink jet type printer head.

First, the printing operation of the printer head will briefly be described. Referring to FIG. 2, when the coil 17 is energized by the signal from print control 25, the plunger 15 confronting the coil core 16 is attracted. The clapper 14 to which the plunger 15 is secured moves to project the wire 11 which engages a distal end of the clapper 14. The tip end of the wire 11 projects through the ink meniscus, carries ink thereon, and hits a sheet of print paper (not shown) to transfer the ink to the printer paper. When the wire 11 is in a standby position, the tip end thereof is located inside of the end surface of the wire guide 13 so that an ink meniscus is formed in front of the tip end of the wire 11. Accordingly, ink is attached successively to the tip end of the wire 11 as the latter is projected and retracted. The transfer of ink to the tip end of the wire, and other details of an inked-wire dot matrix printing process are described in U.S. Pat. No. 4,456,393 issued Jun. 26, 1984, which is incorporated by reference and thus will not be described here in greater detail.

Operation of the ink supply mechanism of the printer head according to the present invention will now be described. For obtaining a proper dot density in inking of an ink dot matrix printing system, it is necessary to apply a continuous appropriate quantity of ink to the tip end of the wire. Therefore, the wire guide hold should have a proper dimension in the vicinity of the wire tip end and a proper amount of ink, without excess or shortage, can be supplied from the ink tank.

In the foregoing printer head construction, the ink guide path from the ink tank 2 to a position in the vicinity of the wire tip end is composed of slots, grooves, and gaps. By selecting suitable dimensions of the widths of the slots, grooves, and gaps, an amount of ink necessary for printing can be guided without an overflow under appropriate capillary attraction. Since the gap between the wire guide 13 and the ink supply guide 12 can be dimensioned to retain ink therein under capillary attraction, an appropriate quantity of ink can be supplied even when the ink supply from the ink supply grooves 12*a* suffers an ink shortage due to increased use of ink.

The dimensions of the ink supply grooves and gaps, the hole diameters of the porous members 61, 62, and the widths of the slots 45 are selected such that the capillary attraction is progressively greater along the ink path. Therefore, ink will not be interrupted in the ink path as described below.

As ink is consumed from the ink tank 2 during printing, ink flows from the porous member 62 through the ink guide slot 12*b*, or through the slots 45 and the ink guide slot 12*b* into the printer head body. Since the ink moves transversely across the porous member 62 at this time, the distance that the ink moves through the porous 62 is small and no ink interruption occurs. When the ink supply in the porous member 62 is exhausted, a pressure difference develops immediately between the ink in the porous member 61 and the ink in the porous member 62. This is due to the difference between their average hole diameters, and the same quantity of ink as consumed is supplied from the porous member 61 to the porous member 62. No ink interruption takes place at this time since the ink moves transversely in and across the porous member 61. The amount of ink retained in the porous member 62 thus remains substantially the same as ink is fed out. Therefore, as the printing operation progresses, the ink in the porous member 61 is first used up, and then the ink in the porous member 62 is used up.

The ink guide mechanism in the printer head body operates to the same advantage. When ink flow in the path is interrupted due to vibrations or the like, the blocked ink is moved forward until it mixes with a preceding mass of ink since the capillary attraction is greater in the ink path than in the ink tank. Since the capillary attraction is greater in the vicinity of the tip end of the wire than the ink path where the ink flow is blocked, ink is not retracted from the tip end of the wire. Hence, the dot density will not be rendered unstable even momentarily, so that all ink on the wire tip end can be used up.

Figure 9:
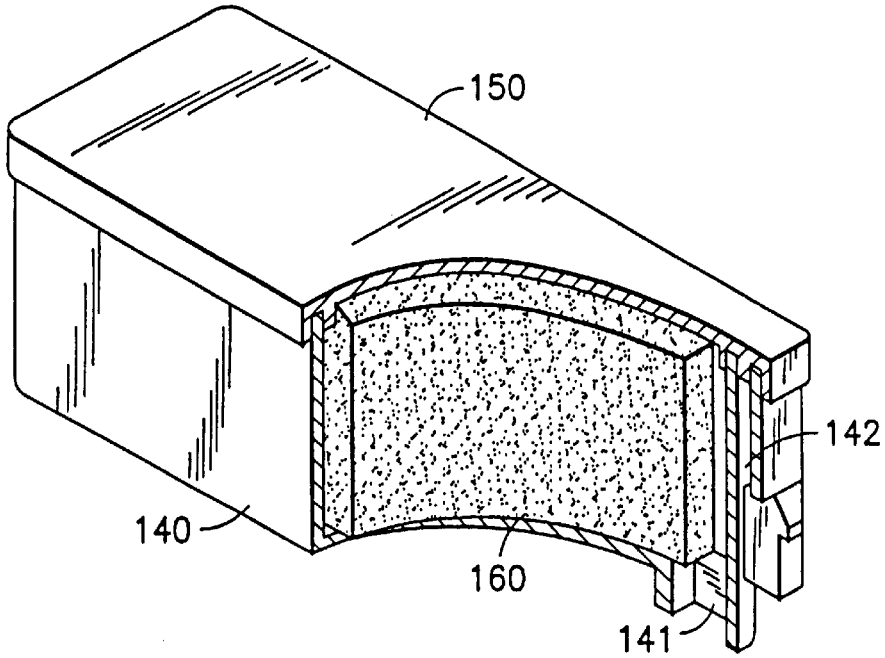
FIG. 9 is a perspective view, partly broken away, of an ink tank according to the invention.
Figure 10:
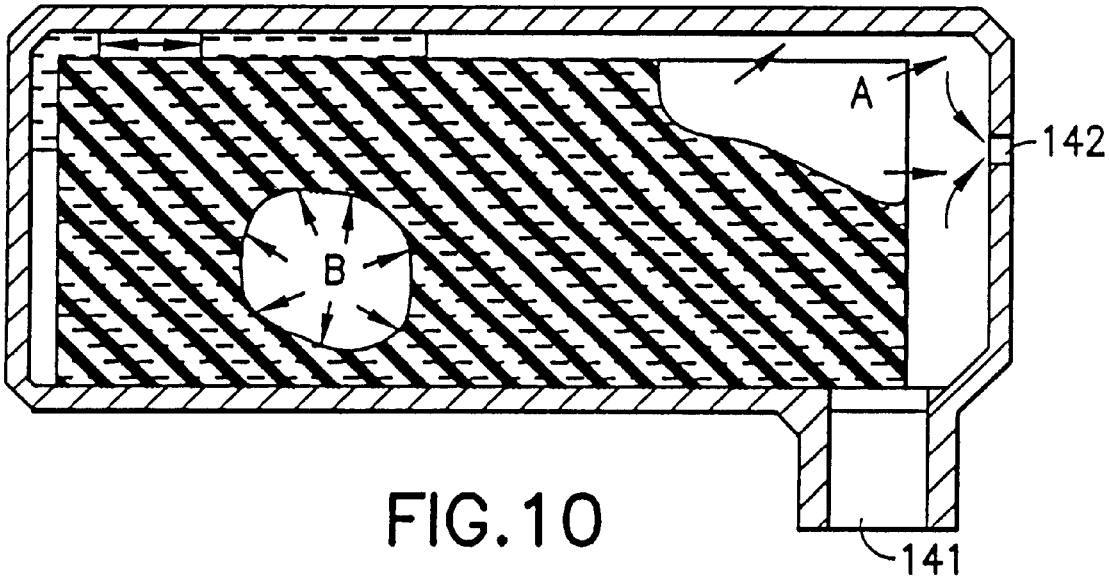
FIG. 10 is a schematic view illustrative of the manner in which air trapped in the ink tank of FIG. 9 is expanded.

FIGS. 9 and 10 of the accompanying drawings illustrate another embodiment of the ink tank construction in accordance with the invention for use with either a wire dot matrix printer or an ink jet type printer with an ink-impregnated member 160 such as of a porous material being enclosed in tank 140. The illustrated ink tank construction is of a simple shape and can supply a suitable amount of ink to a printer head body under appropriate capillary attraction by the ink-impregnated member. The ink tank can be impregnated with a large quantity of ink while preventing unwanted ink outflow from an air hole 142 and an ink supply port 141.

When ink is supplied from the ink tank of such a construction, ink in the tank remote from the ink supply port flows toward the ink supply port under a pressure difference developed between ink close to the ink supply port and ink remote therefrom as capillary attraction of the ink-impregnated member in the vicinity of the ink supply port is increased due to ink consumption. However, as can be seen in porous materials, ink-impregnated members are generally subject to an increased resistance to ink flow and interrupted ink paths preventing a smooth ink flow as the quantity of impregnated ink is reduced. If the ink flow is blocked until a pressure differential sufficient to move ink in the ink tank is produced, then ink remote from the ink supply port remains retained and unused, resulting in a short ink supply duration.

As shown schematically in FIG. 10, the ink tank frequently tends to trap air pockets in the ink-impregnated member. When ambient temperature rises or atmospheric pressure drops, air communicating directly with the air hole expands and is discharged out of the air hole as indicated by the arrows A without applying any pressure on impregnated ink, whereas the completely trapped air is expanded as indicated by the arrows B while moving the ink surrounding it. When such air pocket reaches the ink supply port, an undesired ink outflow occurs. This causes a smear or ink spot on a sheet of print paper, or ink finds its way into a printer head mechanism, resulting in a malfunction.

Figure 4:
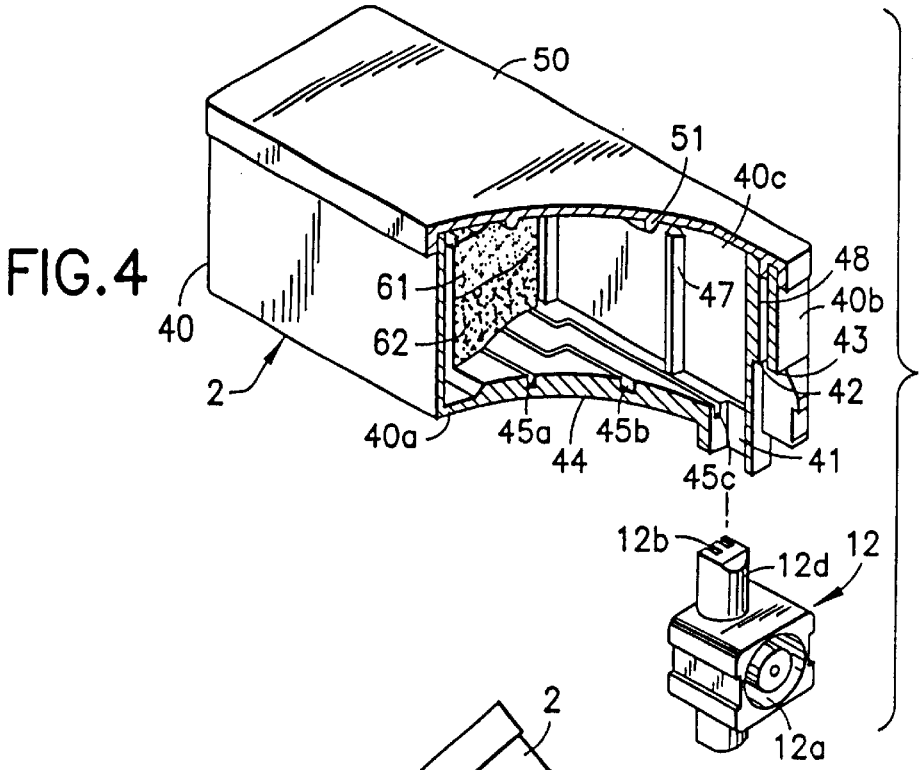
FIG. 4 is a perspective view, partly cut away, of an ink tank according to the present invention.

With the ink tank construction of FIG. 4, the ink-impregnated members are supported on the ridges in the ink body, the ink-impregnated members are surrounded by a layer of air which leads to ambient air through the air hole. Since ink is impregnated under a low pressure, there is substantially no air layer or pocket enclosed by ink in the ink-impregnated members. Therefore, any expansion of air in the tank caused by a temperature rise or a reduction in atmospheric pressure is released through the air hole, so that the pressure in the tank is equalized to atmospheric pressure and does not force the ink out of the ink tank.

The ink tank of the invention is therefore free from an ink outflow due to variations in temperature and atmospheric pressure, and capable of uniformly supplying ink.

The ink tank and ink guide path for supplying ink have dimensions dependent on the accuracy of the shapes of the components. Since the components can be formed easily with high dimensional accuracy by molding, the ink tank and ink guide path are highly dimensionally accurate and can supply ink uniformly. The ink tank and ink guide path can easily be assembled as they are composed of a small number of parts. They are free from wear and deformation for a long period of use and can keep initial performance partly because of the lubrication capability of ink.

Figure 6:
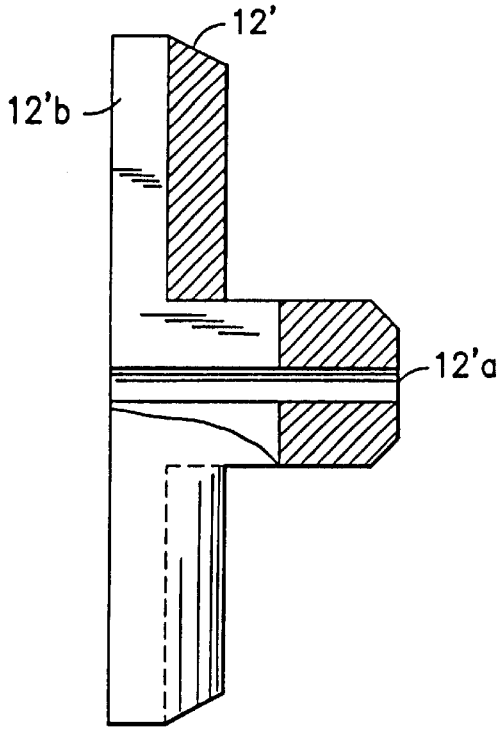
FIG. 6 is a vertical cross-sectional view of an ink guide for a wire dot printer according to another embodiment of the present invention.

FIG. 6 shows an ink guide member 12' according to another embodiment of the present invention. The ink guide member 12' is of an integral construction comprising the ink supply guide 12 and the wire guide 13 described in the preceding embodiment. The ink guide member 12' has an ink guide groove 12'*b* capable of guiding and holding ink for application to wire hole 12'*a*. The ink guide member 12' operates in the same manner as described with reference to the foregoing embodiment.

Figure 7:
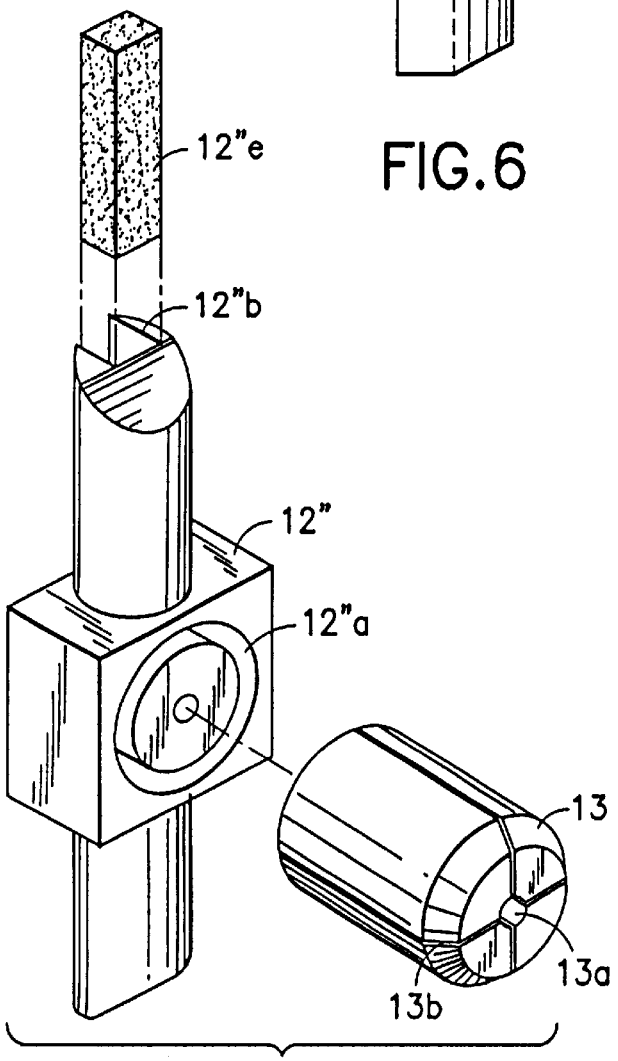
FIG. 7 is an exploded perspective view of an ink guide for a wire dot printer according to another embodiment of the present invention.

FIG. 7 is an exploded perspective view of an ink guide member 12" according to still another embodiment of the present invention. The ink guide member 12" includes an ink guide porous member 12"*e* disposed in the ink guide groove 12"*b* and serving as an extension of the ink absorbing members in the ink tank into the ink guide path. Operation of the ink guide member 12" is essentially the same as that of the previous embodiments.

Figure 8:
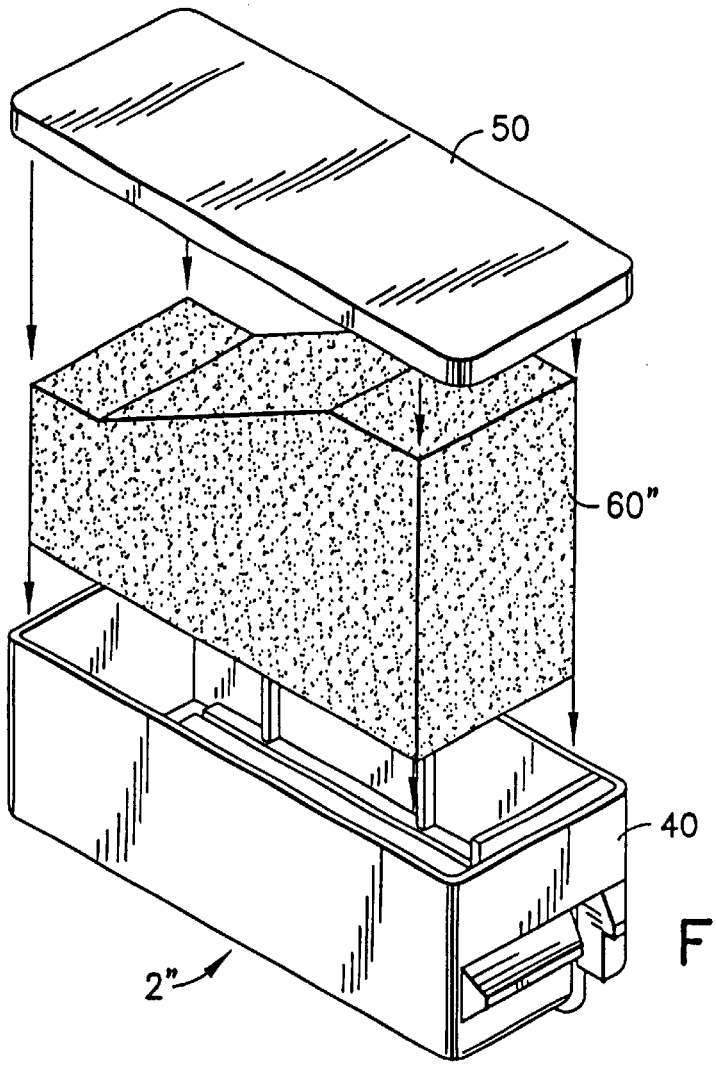
FIG. 8 is an exploded perspective view of an ink tank according to a still further embodiment of the present invention.

FIG. 8 is an exploded perspective view of an ink tank 2" according to another embodiment of the present invention. The parts other than a porous member 60" are the same as those in the embodiment shown in FIG. 4. The porous member 60" has different front and rear thicknesses so that the thicker front portion is compressed by the tank lid 50 when the porous member 60" is filled in the tank body 40. Therefore, even if the porous member 60" has uniform hole diameters, the front portion thereof has a smaller average hole diameter with the hole diameter becoming progressively greater toward the rear portion at the time the porous member 60" is placed in ink tank body 40. The porous member 60" is structurally equivalent to a plurality of porous sheet layers of different average hole diameters which are placed in the ink tank body 40 with the average hole diameters member 60". Therefore, operation of the porous member 60" is basically the same as that of the porous members 61, 62 shown in FIG. 4. Compression in the vicinity of the ink supply port is also achieved where the ink absorbing member overlies the opening (141) in the tank as shown in FIGS. 9 and 10, since arm 12*d* of ink supply guide 12 is inserted through the opening into compressing engagement with the ink absorbing member in such a construction (compare FIGS. 2, 4, 9 and 10).

Figure 12:
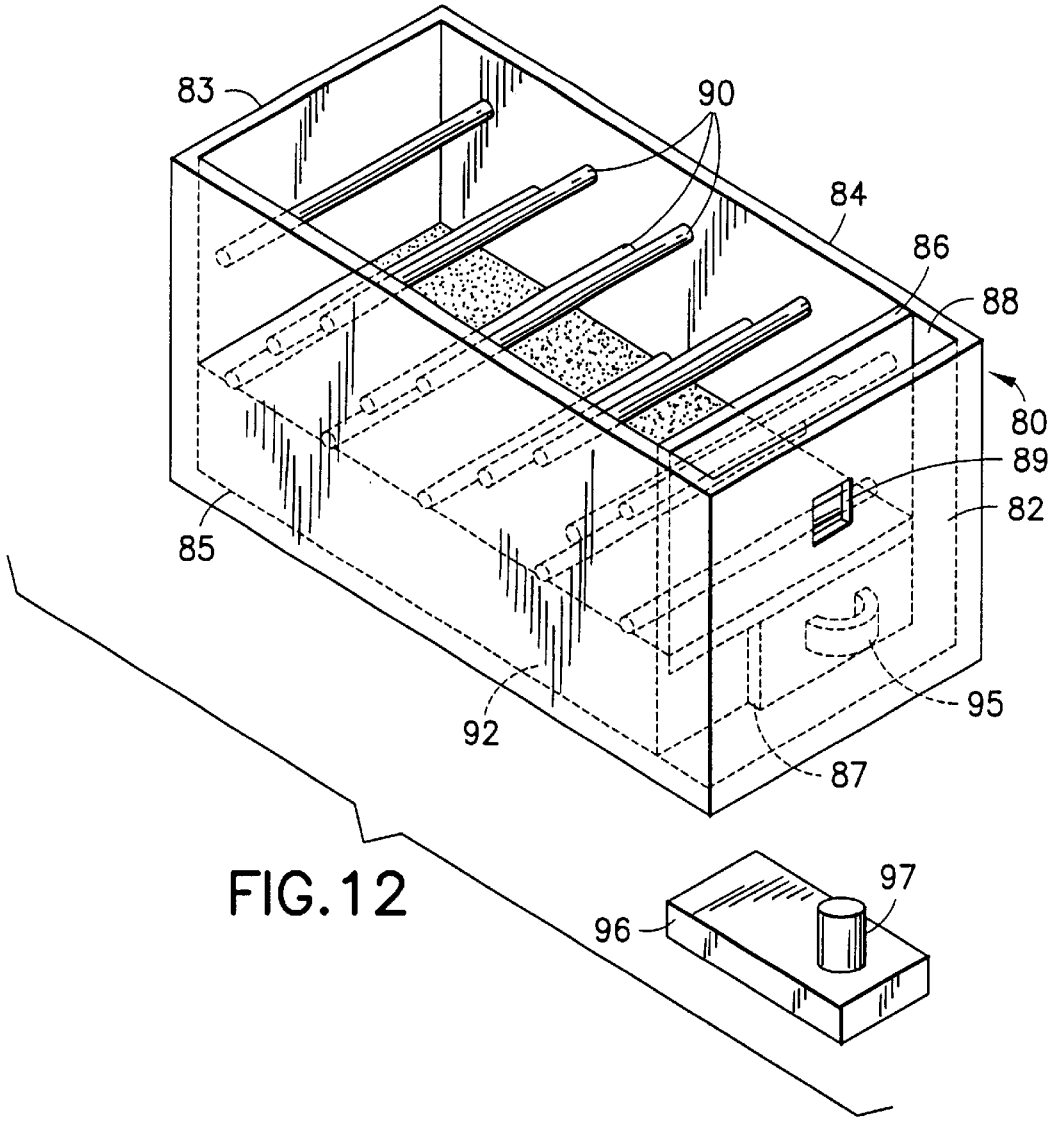
FIG. 12 is a perspective view of an ink tank according to a further embodiment of the present invention with the cover removed, shown exploded from an ink jet print head.
Figure 13:
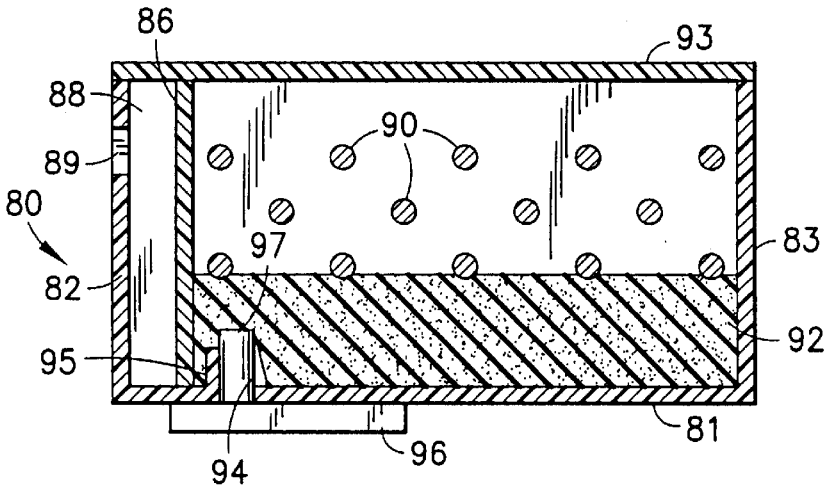
FIG. 13 is a cross-sectional view of the ink tank of FIG. 12.

FIGS. 12 and 13 depict an ink tank 80 according to an alternative embodiment of the present invention. Ink tank 80 is formed of bottom wall 81 (FIG. 13), a lid or cover 93 (FIG. 13) (removed in FIG. 12), end walls 82 and 83, side walls 84 and 85, and internal partition wall 86. Side walls 84 and 85 may be formed of a transparent material to allow the user to more easily determine the quantity of ink remaining in ink tank 80. An opening 94 is formed in the bottom wall 81 of tank 80 and a guide wall 95 extends into the interior of tank 80 partially extending about the opening. Ink absorbing member 92 is placed in the portion of ink tank 80, defined by side walls 84 and 85, end wall 83, partition wall 86 and the lower row of support rods 90, filling approximately less than half of the total internal volume of tank body 80.

A plurality of support rods 90 extend in three staggered rows between the internal surfaces of side walls 84 and 85 within ink tank 80.

In this embodiment, support rods 90 are used in place of a second ink absorbing member of greater porosity, such as ink absorbing member 61 of FIG. 4, with the added benefit that the volume of tank body 80 available for holding ink is increased. Support rods 90 also insure that side walls 84 and 85 do not deform upon application of increased pressure, providing increased structural integrity to the ink tank.

An ink jet print head 96 is provided with an ink receiving and transmitting member 97 which is received in opening 94 of bottom wall 81 of ink tank 80, so that the end thereof, defining an ink port, engages the ink absorbing member 92. As is shown in FIG. 13, at least a portion (the bottom row in this embodiment) of support rods 90 are located in contact with ink absorbing member 92, especially in close proximity to where ink opening 94 is located. Thus, at least one of support rods 90 acts as a resistance mechanism against the compressive force imparted to ink absorbing member 92 by ink receiving and transmitting member 97 and serve to position the ink absorbing member 92 in a lower portion of the ink tank 80. Ink receiving and transmitting member 97 projects from the plane of bottom wall 81 from a location closer to partition wall 86 of ink tank 80 than to end wall 83. This location aids in insuring compression as desired in the region of the ink absorbing member facing the ink port. Such compression aids in delivering ink to the ink port and aids in preventing air bubbles, if any, from reaching the ink port.

Partition wall 86 is formed with a cut-out portion 87 below the level of ink absorbing member 92 communicating with an ambient air compartment 88. Thus, ink absorbing member 92 covers substantially all of cut-out portion 87. Compartment 88 is defined by partition wall 86, end wall 82, lid 93, and the right ends of side walls 84 and 85 as viewed in FIG. 12. End wall 82 is formed with an air vent port 89 above the level of ink absorbing member 92, exposing compartment 88 to ambient air.

In use, ink tank 80 would preferably be filled with ink under low pressure conditions so that ink absorbing member 92 is filled with ink and is essentially free of air bubbles, and the portion of ink tank 80 between ink absorbing member 92, lid 93, end wall 83, partition wall 86 and side walls 84 and 85 is filled with liquid ink. Support rods 90 serve the additional purpose of dampening the flow of ink within the space above ink absorbing member 92 when the ink tank is displaced during printing. In the usual case, the ink tank is mounted on a print head and carriage for oscillatory motion. In any event, since the ink absorbing member extends along the entire bottom of the chamber defined in the ink tank above the ink absorbing member, ink will tend to remain in contact with the ink absorbing member to replenish it even if the carriage moves during printing.

Figure 14:
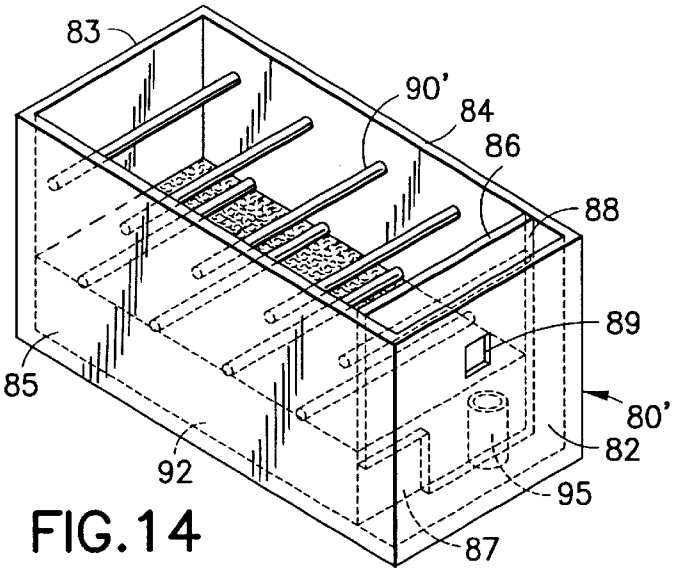
FIG. 14 is a perspective view of an ink tank with the cover removed according to a still further embodiment of the present invention.
Figure 15:
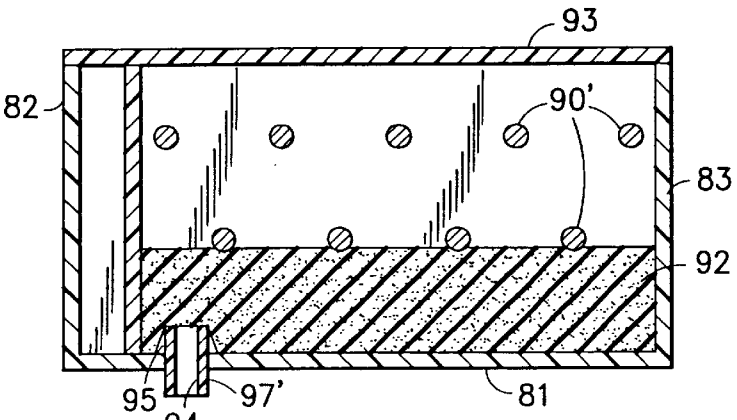
FIG. 15 is a side cross-sectional view of the ink tank of FIG. 14.

FIGS. 14 and 15 depict an ink tank according to a second alternative embodiment of the present invention. In this embodiment, all parts and functions of ink tank 80' are essentially similar to those in the previous embodiment, like reference numerals being used for like elements, except that the number of support rods 90' is reduced and support rods 90' are repositioned into two rows in order to further increase the volume of ink tank 80 available for the storage of ink. Even with this decreased number of support rods 90', at least one of support rods 90' is placed in close proximity to ink receiving and transmitting member 97', so as to oppose the compressive force imparted upon ink absorbing member 92 by ink receiving and transmitting member 97', as is shown in FIG. 15.

Figure 16:
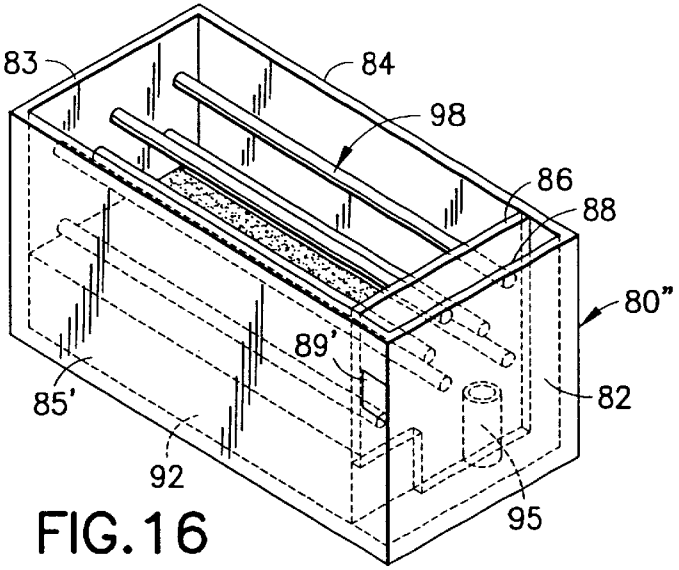
FIG. 16 is a perspective view of an ink tank with the cover removed according to a still further embodiment of the present invention.
Figure 17:
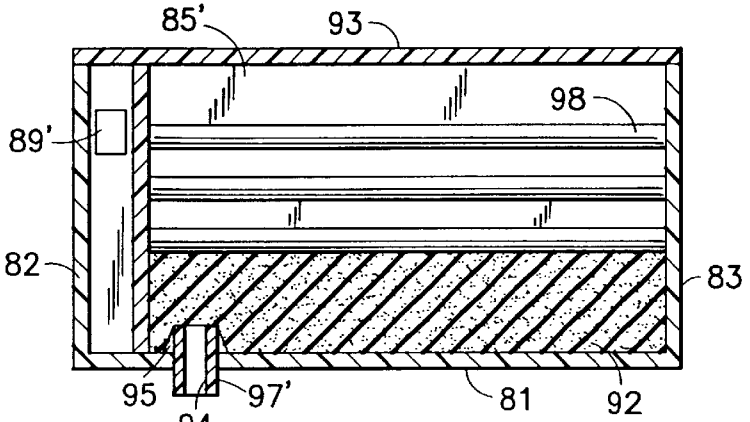
FIG. 17 is a cross-sectional view of the ink tank of FIG. 16.

FIGS. 16 and 17 depict an ink tank 80" according to a third alternative embodiment of the present invention, like reference numerals being used for like elements. This embodiment is similar in structure to the embodiment depicted in FIGS. 12 and 13. In this embodiment, in place of support rods 90 or 90' extending between side walls 84 and 85, long support rods 98 are located above ink absorbing member 92 supported between the internal surfaces of end wall 83 and partition wall 86. As is shown in FIG. 17, air vent hole 89' is located in exterior side wall 85' in the portion which helps define compartment 88.

Referring now to FIG. 18, ink tank 80" is shown mounted on an ink jet print head 100, which is in turn mounted on a carriage 102, which itself is mounted on support beams 104 for reciprocal displacement relative to a print medium (not shown). Print head 100 would include an ink receiving and transmitting member 106 for receiving ink from ink tank 80" and delivering such ink by capillary action to the operative mechanism of the ink jet print head. The ink jet print head is also provided with an output nozzle array 108 for applying the ink to an ink medium (not shown) which can be displaced in the direction normal to the longitudinal direction of support beams 104 to permit print on an entire sheet of the print media. A mesh filter 110 is provided at the end of ink transmitting and receiving member 106 to filter the ink received from the ink absorbing member.

According to the preferred embodiments of the ink tank depicted in FIGS. 12–18, the same ink flow procedure will take place as that noted above in connection with FIG. 4. However, the upper portion of the ink tank will not be filled with a porous member 61. Rather, the upper portion of the ink tank will be filled with ink and support rods 90, 90' or 98. As a result, ink will not move from porous member 61 to 62, but rather will move from the portion of the tank containing the liquid ink and support rods 90, 90' or long support rods 98 into porous member 92. In all other respects, operation of these embodiments are similar to the operation as set forth above.

Figure 19:
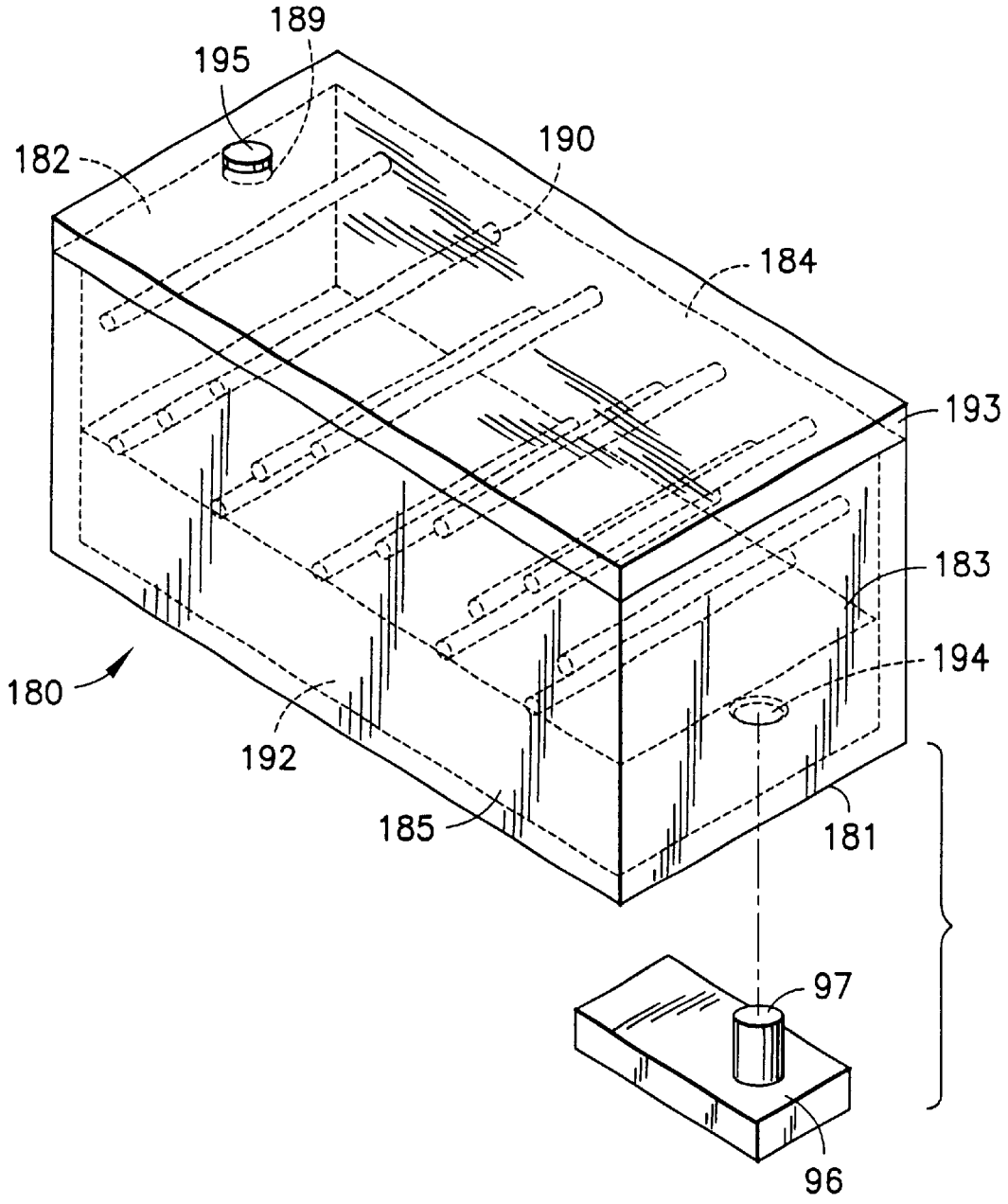
FIG. 19 is a perspective view of an ink tank according to still another embodiment of the present invention shown exploded from an ink jet print head.

FIG. 19 differs from the embodiment of FIG. 12 principally by the elimination of partition wall 86 and in the design of the air vent. In addition, FIG. 19 depicts an ink tank 180 according to still another embodiment of the present invention. Ink tank 180 is formed with bottom wall 181, a lid or cover 193, end walls 182 and 183, and side walls 184 and 185. Side walls 184 and 185 may be formed of transparent material to allow the user to more easily determine the quantity of ink remaining in ink tank 180. An opening 194 is formed in the bottom wall 181 of tank 180. Ink absorbing member 192 is placed in the portion of ink tank 180, defined by side walls 184 and 185, and end walls 182 and 183, and a lower row of support rods 190, filling approximately less than half of the total internal volume of tank body 180.

A plurality of support rods 190 extend in three staggered rows between the internal surfaces of side walls 184 and 185 within ink tank 180.

In this embodiment, support rods 190 are used in place of a second ink absorbing member of greater porosity, such as ink absorbing member 61 of FIG. 4, with the added benefit that the volume of tank body 180 available for holding ink is increased. Support rods 190 also insure that side walls 184 and 185 do not deform upon application of increased pressure, providing increased structural integrity to the ink tank.

An ink jet print head 96 is provided with an ink receiving and transmitting member 97 which is received in opening 194 of bottom wall 181 of ink tank 180, so that the end thereof, defining an ink port, engages the ink absorbing member 192. At least a portion (the bottom row in this embodiment) of support rods 190 are located in contact with ink absorbing member 192, especially in close proximity to where ink opening 194 is located. Thus, at least one of support rods 190 acts as a resistance mechanism against the compressive force imparted to ink absorbing member 192 by ink receiving and transmitting member 97 and serves to position the ink absorbing member 92 in a lower portion of the ink tank 80. Ink receiving and transmitting member 97 projects from the plane of bottom wall 181 from a location closer to end wall 183 of ink tank 180 than to end wall 182. This location aids in insuring compression as desired in the region of the ink absorbing member facing the ink port. Such compression aids in delivering ink to the ink port and aids in preventing air bubbles, if any, from reaching the ink port.

Lid 193 is formed with an air vent port 189 formed therein. A plug member 195 is provided in air vent port 189. Plug member 195 is formed of a material which renders the plug member air permeable, but not permeable to ink or other liquids.

In use, ink tank 180 would preferably be filled with ink under low pressure conditions so that ink absorbing member 192 is filled with ink and is essentially free of air bubbles, and the portion of ink tank 180 between ink absorbing member 192, lid 193, end walls 182 and 183, and side walls 84 and 85 is filled with liquid ink. Support rods 190 serve the additional purpose of dampening the flow of ink within the space above ink absorbing member 192 when the ink tank is displaced during printing. In the usual case, the ink tank is mounted on a print head and carriage for oscillatory motion. In any event, since the ink absorbing member extends along the entire bottom of the chamber defined in the ink tank above the ink absorbing member, ink will tend to remain in contact with the ink absorbing member to replenish it even if the carriage moves during printing.

In a manner similar to FIG. 19, the embodiments of FIGS. 14–18 could likewise be made without a partition wall.

Figure 20:
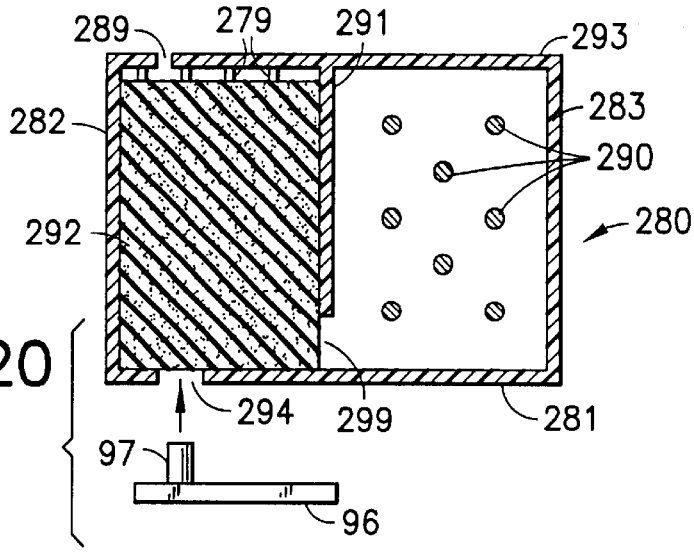
FIG. 20 is a cross-sectional view of an ink tank according to a still further embodiment of the present invention.
Figure 21:
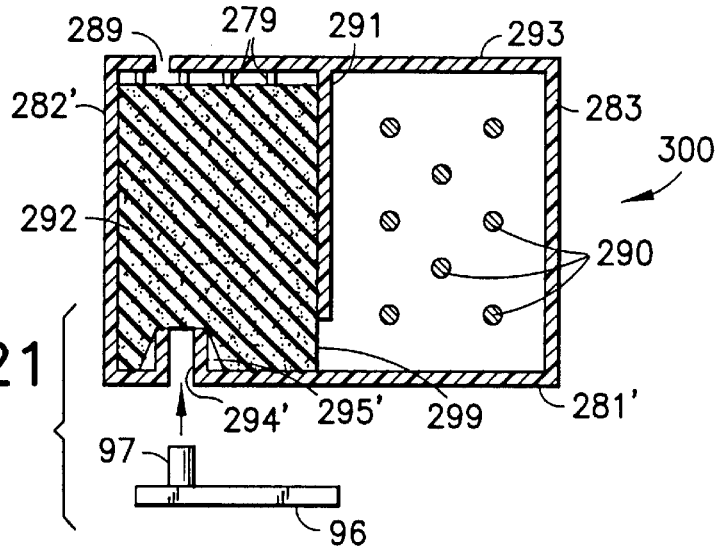
FIG. 21 is a cross-sectional view of an ink tank according to a further embodiment of the present invention.
Figure 22:
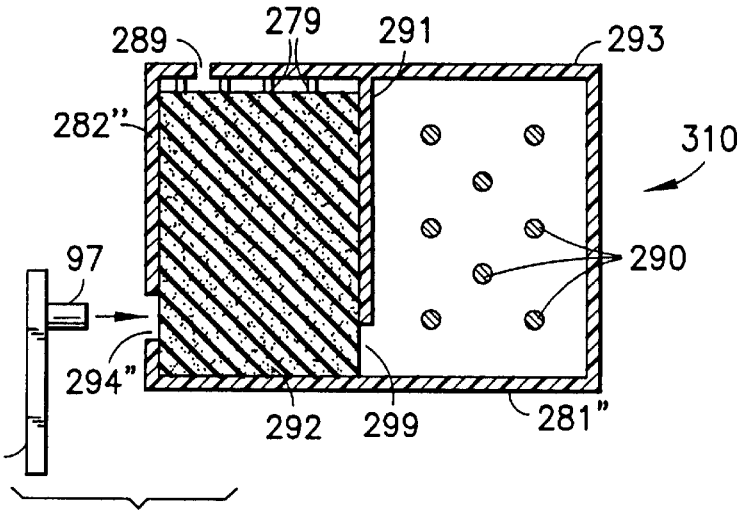
FIG. 22 is a cross sectional view of an ink tank according to a further embodiment of the present invention.

FIGS. 20–22 depict ink tanks according to additional alternative embodiments of the present invention. As is depicted in FIG. 20, ink tank 280 is formed with bottom wall 281, a lid or cover 293, end walls 282 and 283, and side walls (not shown in FIG. 20). The side walls 284 and 285 (not shown) may be formed of a transparent material to allow the user to more easily determine the quantity of ink remaining in ink tank 280. An opening 294 is formed in the bottom wall 281 of ink tank 280. A partition wall 291 extends vertically intermediate end walls 282 and 283 from cover 293 to define two chambers formed by communicating passage 299 defined between the lower edge of partition wall 293 and bottom wall 281. Ink-absorbing member 292 is disposed in the chamber defined by the portion of ink-supply tank 280 between end wall 282 and partition wall 291. Support rods 290 are disposed in the chamber defined by the portion of ink-supply tank 280 between partition wall 291 and end wall 283. An air vent port 289 is formed in lid 293 positioned to be in registration with the chamber of ink tank 280 containing ink-absorbing member 292. A plurality of projections 279 are formed on the underside of lid 293 in the chamber of ink tank 280 containing ink-absorbing member 292.

An ink jet print head 96 is provided with an ink receiving and transmitting member 97 which is received in opening 294 of bottom wall 281 of ink tank 280, so that the end thereof, defining an ink port, engages ink absorbing member 292. Ink receiving and transmitting member 97 projects from the plane of bottom wall 281 from a location in the portion of ink tank 280 containing ink-absorbing member 292. This location aids in insuring compression as desired in the region of the ink-absorbing member facing the ink port. Such compression aids in delivering ink to the ink port and aids in preventing air bubbles, if any, from reaching the ink port.

In use, ink tank 280 would preferably be filled with ink under low pressure conditions so that ink absorbing member 292 is filled with ink and is essentially free of air bubbles, and the portion of ink tank 280 containing support rods 290 is filled with liquid ink. In addition to providing additional structural support to ink tank 280, support rods 290 serve the additional purpose of dampening the flow of ink within the space aside ink absorbing member 292 when the ink tank is displaced during printing. In the usual case, the ink tank is mounted on a print head and carriage for oscillatory motion. In any event, since the ink absorbing member extends along the bottom of the chamber in proximity to the ink port, ink will tend to remain in contact with the ink absorbing member to replenish it even if the carriage moves during printing.

FIG. 21 depicts an ink tank 300 according to an additional alternative embodiment of the present invention, like reference numerals being used for like elements. This embodiment is similar in structure to the embodiment depicted in FIG. 20. In this embodiment, an opening 294' is formed in the bottom wall 281' of ink tank 300, and a guide wall 295' extends into the interior of tank partially extending about opening 294'. This guide wall further aids in local compression of ink-absorbing member 292.

FIG. 22 depicts an ink tank 310 according to an additional alternative embodiment of the present invention, like reference numerals being used for like elements. This embodiment is similar in structure to the embodiments depicted in FIGS. 20 and 21. In this embodiment, an opening 294" is formed in end wall 282" of ink tank 310. An ink jet print head 96 is provided with an ink receiving and transmitting member 97 which is received in opening 294" of end wall 282" of ink tank 310, so that the end thereof, defining an ink port, engages ink absorbing member 292. Ink receiving and transmitting member 97 projects from the plane of end wall 282" from a location in the portion of ink tank 300 containing ink-absorbing member 292. This location aids in insuring compression as desired in the region of the ink-absorbing member facing the ink port. Such compression aids in delivering ink to the ink port and aids in preventing air bubbles, if any, from reaching the ink port.

Operation of the ink supply tank of the embodiments of FIGS. 20–22 will now be described. Reference will be made specifically to FIG. 20 with the understanding that the embodiments of FIGS. 21 and 22 operate similarly. As ink is consumed from the ink tank 280, the ink level in the chamber between partition wall 291 and side wall 283 falls as ink leaves that chamber and is absorbed in ink-absorbing member 292. When the chamber between partition wall 291 and side wall 283 is essentially empty, the ink level will then be reduced in the area of the ink absorbing member away from ink port 294 in that the ink will be carried toward ink port 294 through capillary action. Ambient air from air vent 289 passes through ink absorbing member 292 and communicating passage 299 into the chamber between partition wall 291 and side wall 283.

While in the foregoing embodiment of FIG. 1 the ink tank is placed above the printer head, the tank may be located below the wires to achieve a stable printing density through the ink guiding process according to the present invention.

Figure 11:
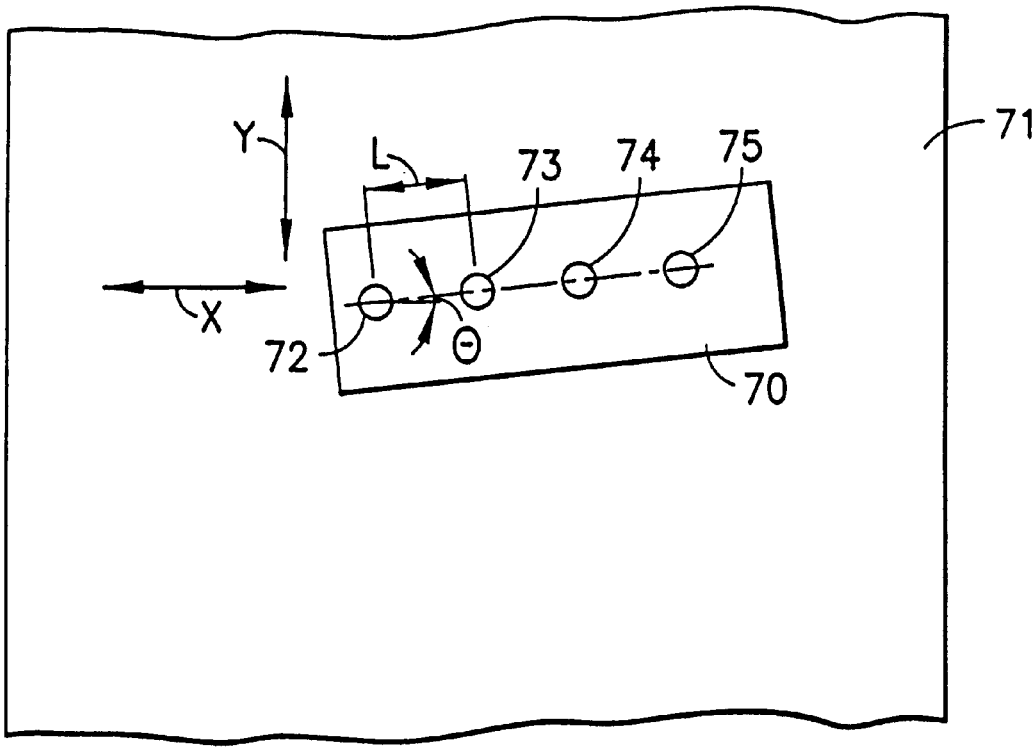
FIG. 11 is a schematic view of an arrangement of wires according to the present invention used with a seven-color wire dot printer.

The construction of a seven-color printer is schematically shown in FIG. 11. A printer head 70 is movable back and forth in the direction of the arrow X, and a sheet of print paper 71 is fed along successively by one line pitch in the direction of the arrow Y. An array of wire positions 72, 73, 74, 75 on the printer head 70 extends along a straight line inclined at an angle with respect to the scanning directions X, the wire positions being spaced in the direction Y at a pitch of L sin θ. Yellow-ink, magenta-ink, cyan-ink and black-ink wires are located in the positions 72, 73, 74 and 75, respectively, to effect color-image printing free from undesired color mixing. Since a dot of one color is put on a dot of another color for mixed color formation, seven-color image printers are generally liable to suffer from unwanted color mixing because the ink of the former color is applied to the wire carrying the ink of the later color. According to the printer construction of FIG. 11, the ink of yellow which is most susceptible to the influence of the inks of the other colors is first applied to the print paper to prevent the inks of the other colors from being attached to the tip end of the wire carrying the yellow ink, thus avoiding the mixture of the yellow ink with the inks of the other colors. Also, as seen in FIG. 11, angle θ is an angle selected to permit adjacent wire positions to be partially out of registration with each other in a direction normal to the direction of printer head displacement (scanning) relative to paper 71 (direction of arrows X).

With the present invention, ink can be uniformly supplied through a simple construction from an ink tank to a printer head, and ink is uniformly provided to the printer head for producing a uniform and proper ink density. In the printer head of the invention, ink flow will not be interrupted in an ink guide path to prevent an ink supply failure. A quantity of ink absorbed in the ink guide path is smaller than would be absorbed with a conventional arrangement in which a porous member is used to apply ink directly to the tip end of the wire. Therefore, any wasted ink which is not used for printing is of a small quantity, and all the ink in an ink tank can effectively be used for printing. When the ink tank runs short of ink, and the ink in the tank is rendered highly viscous by being dried at high temperature, or is solidified and thus failing to supply ink, a cartridge ink tank can be mounted in place so that fresh ink can immediately be supplied to the print head for resuming desired printing operation.

According to the printer head of the present invention, no ink flow interruption occurs due to variations in temperature and atmospheric pressure and a uniform ink density is produced. Unintentional ink flow out of the ink tank is avoided, thus avoiding smearing the print paper with the undesired ink spots. Ink will not enter the printer head mechanism, preventing malfunctioning. The cartridge ink tank can easily be detached and attached for ink replenishment.

Since the ink supply system of the invention is simple in construction, it takes up a small space. Where a multicolor printer head employs ink supply systems of the invention, the ink supply systems for different ink colors can be spaced widely so that mixing of colors can be avoided.

Figure 23:
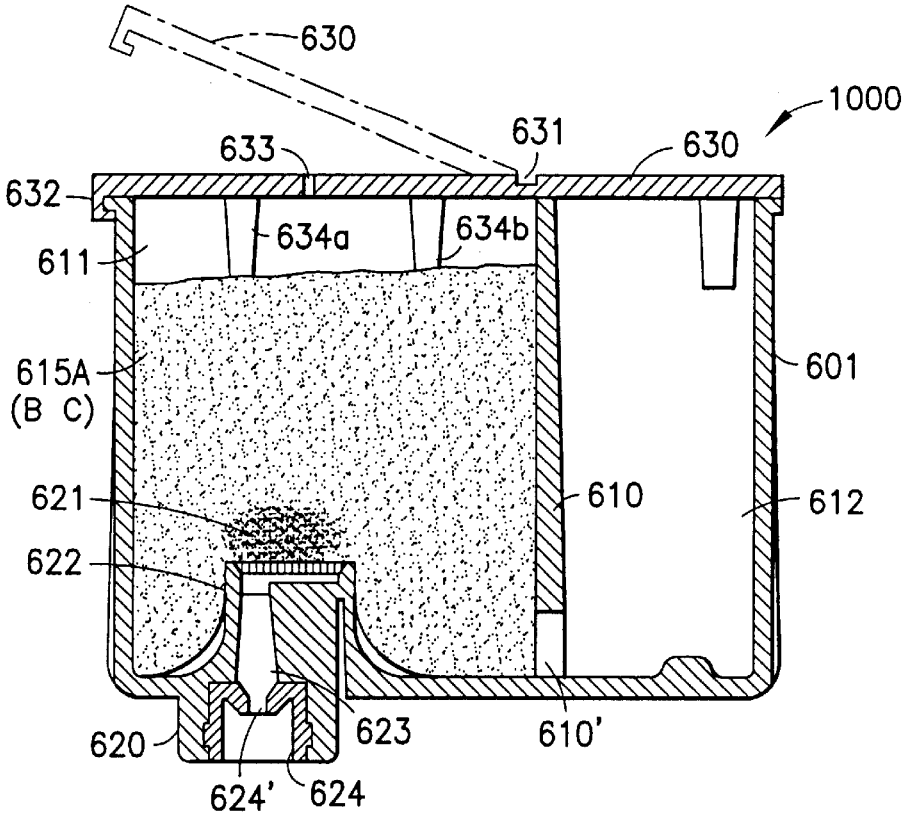
FIG. 23 is a cross-sectional view of an ink tank constructed in accordance with a first additional embodiment of the invention.
Figure 24:
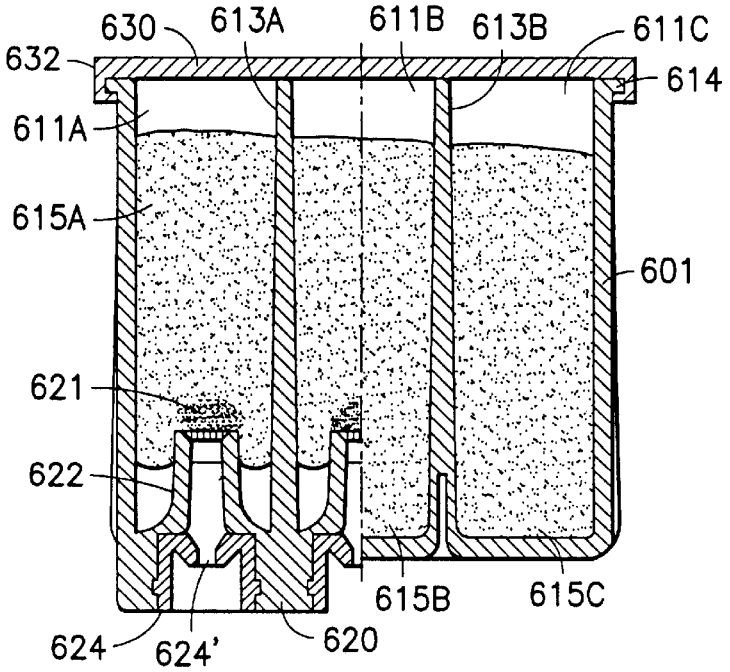
FIG. 24 is a cross-sectional side view of the ink tank of FIG. 23.

Reference is next made to FIGS. 23 and 24 which depict an ink tank 1000 constructed in accordance with a first additional embodiment of the invention having a partition 610 disposed in a container 601 so as to form first and second chambers 611 and 612. In ink tank 1000, two compartment walls 613A and 613B extend in a direction perpendicular to partition 610 and are situated so as to form three adjacent equal first chambers 611A, 611B, and 611C commonly referred to as 611. One second chamber 612A, 612B and 612C associated respectively with each first chamber 611A, 611B and 611C is provided, but not seen in FIG. 24. The structure and operation of compartments 611A–611C are identical and a representative compartment 611 will be described below for ease of description.

Ink absorbing members 615A, 615B, and 615C (collectively 615) are housed in a respective first chamber 611. In each of the ink absorbing members, yellow, magenta, or cyan ink is absorbed by the associated ink absorbing member 615. Each ink absorbing member 615 is a porous member which may be formed, for example, by foaming a polyurethane material. Each ink absorbing member 615 has a volume which is larger than the capacity of the respective first chamber 611 and is therefore housed in the respective first chamber 611 under compression. An associated ink supply port member 620A, 620B or 620C (collectively 620) is disposed in a bottom of first chamber 611.

First chamber 611 is provided with ink supply port member 620 through which an ink supply needle of a recording head (as shown in FIG. 1) passes and is engaged. Ink supply port member 620 is formed with a tubular shape. Top 622 of ink supply port member 620 which is covered by a filter 621 pushes against ink absorbing member 615 so as to slightly compress the ink absorbing member in the vicinity of ink supply port member 620, thereby enhancing the capillary force by which the ink flows. A packing member 624 having an opening 624' is fitted into a though hole 623 of ink supply port member 620 through which the ink supply needle is passed and forms a liquid tight seal with packing member 624. Additional ink is stored in each of second chambers 612A, 612B and 612C (collectively 612) which communicate with first chambers 611 respectively via slit-like communicating holes 610 formed in the lower portion of partition 610. A rib 614 extends around container 601.

A lid 630 is placed on the top opening of container 601. Lid 630 hermetically seals second chambers 612 and can be bent along a hinge type portion 631 in order to open lid 630. An engaging portion 632 is formed in the periphery of lid 630 and is directed inward. Engaging portion 632 detachably engages with rib 614 formed at the top of container 601 and is directed outward, whereby the top openings of compartment 611 can be selectively closed.

An air vent hole 633 is formed in lid 630 so that ambient air of a quantity corresponding to the quantity of consumed ink flows into container 601.

In FIG. 23, reference numerals 634*a* and 634*b* designate the pressers which extend vertically from the inner face of lid 630 which compress ink absorbing member 615 against ink supply port 620. (Each chamber 611A, 611B and 611C have corresponding pressers 634*a* and 634*b*. This configuration will be generally described, but is applicable to each of the similar containers.) When the top opening of container 601 is closed by lid 630, pressers 634*a* and 634*b* are urged so as to partially press down on ink absorbing member 615. Presser 634*a* which opposes ink supply port member 620 is longer than presser 634*b* which is positioned away from ink supply port member 620. These pressers cooperate with ink supply port member 620 to further compress the portion of ink absorbing member 615 adjacent ink supply port member 620.

Figure 25A:
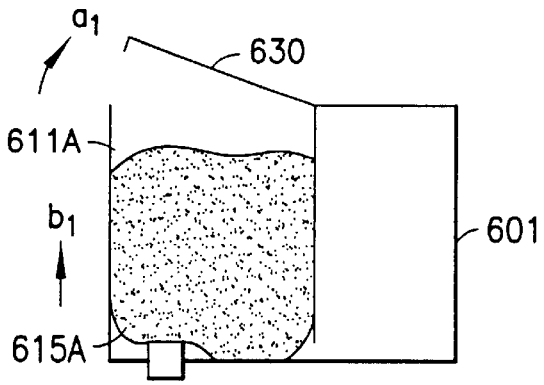
FIGS. 25(*a*), 25(*b*) and 25(*c*) are schematic diagrams illustrating the steps of supplying ink to an ink tank in accordance with the first embodiment of the invention.
Figure 25B:
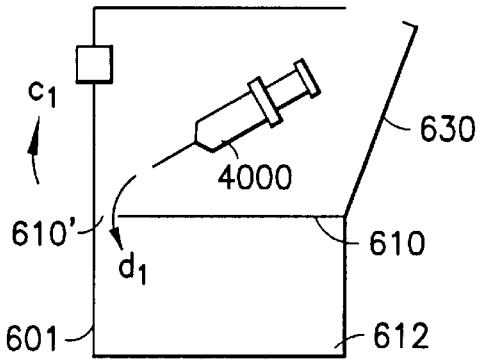
Figure 25C:
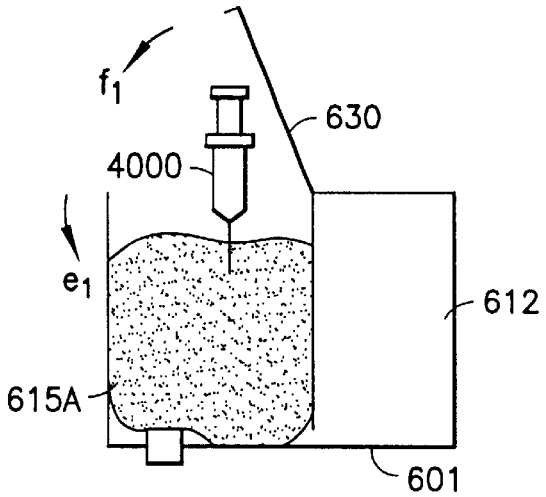

During printing, the method of use of ink tank 1000 is similar to that of prior art ink tanks. However, when ink in container 601 is depleted as a result of the printing operation, the ink tank of the invention may be refilled, rather than being discarded. The process of refilling container 601 with ink will be hereinafter described in connection with FIGS. 25*a*–25*c*.

When the ink cartridge is to be refilled, lid 630 is manually pulled up in the direction of arrow $a_1$ and opened about hinge type portion 631, which functions as the fulcrum, so that inward engaging portion 632 of lid 630 is disengaged from outward rib 614 of container 601. Thereafter lid 630 is moved as indicated by the phantom line in FIG. 23 to open compartment 611A. Thereafter, the depleted ink absorbing member 615A may be extracted from compartment 611A in the direction of arrow $b_1$ if necessary.

Next, container 601 is rotated in the direction of arrow $c_1$ by 90° so that first chamber 611 is positioned above second chamber 612 as shown in FIG. 25(*c*). Thereafter, by using an injection device 4000, ink is filled in second chamber 612 via communicating hole 610' of partition 610 in the direction of arrow $d_1$.

Figure 36:
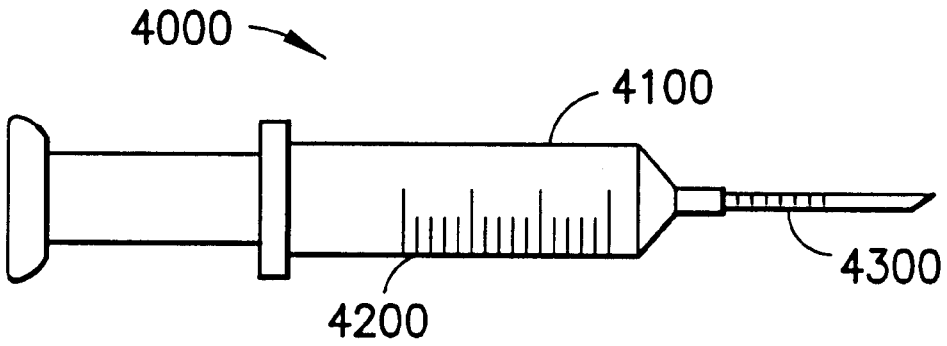
FIG. 36 is a side elevational view of an ink injection device constructed in accordance with the invention.

As is shown in FIG. 36, an injection device 4000 includes a container 4100, which may be transparent, and a scale 4200 may be formed thereon. Thus, the user can see the quantity of ink being injected into second chamber 612. A needle portion 4300 is coupled to container portion 4100 and is in fluid communication therewith.

Thereafter, ink absorbing member 615A is inserted into first chamber 611A, and ink is injected into ink absorbing member 615A by the injection device 4000 as shown in FIG. 25(*c*). If ink absorbing member 615A was not initially removed, ink would be refilled in both chambers while ink absorbing member 615A was still in first chamber 611A. This process would be repeated for each chamber 611 needing replenishing.

Finally, lid 630 is swung in the direction of arrow $f_1$, and inward engaging portion 632 is engaged with the outward rib 614 so as to restore the ink tank to its state shown in FIG. 23, thereby completing the work of refilling fresh ink.

Figure 26:
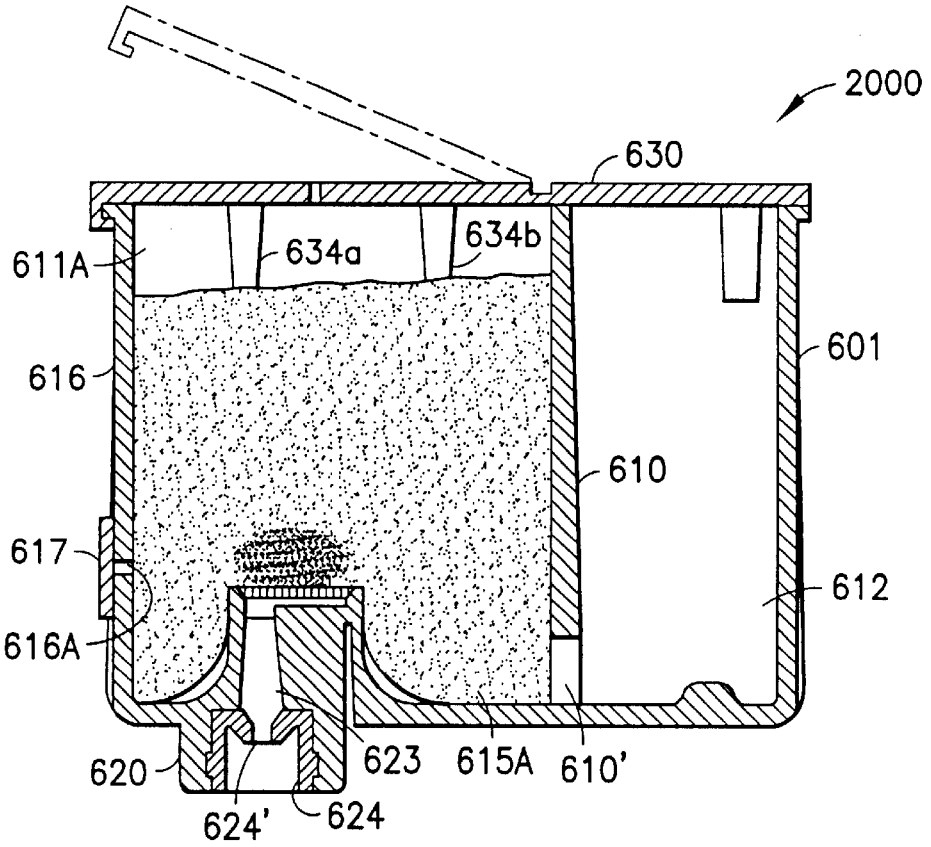
FIG. 26 is a cross-sectional view of an ink tank constructed in accordance with a second additional embodiment of the invention.
Figure 27:
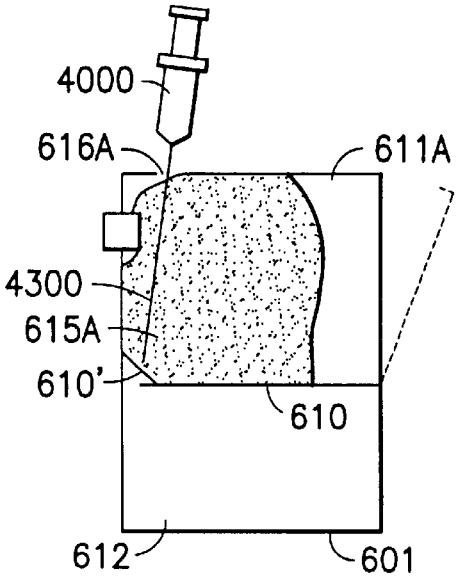
FIG. 27 is a schematic diagram illustrating the steps of supplying ink to the ink tank of FIG. 26.

Reference is now made to FIGS. 26 and 27 depicting an ink tank constructed in accordance with a second embodiment of the present invention. Like reference numerals denote like elements as those of the first embodiment, and as such will not be described again here. The primary difference being a through hole for feeding ink into the interior of the ink tank.

A through hole 616A is formed in a side wall 616 of compartment 611A of an ink tank 2000 and a seal 617 is applied thereto. During the refilling process, lid 630 is opened, the depleted ink absorbing member 615A is removed, the new ink absorbing member 615A is replaced in the tank, and lid 630 is closed, as described above.

Next, ink is filled into the ink absorbing member 615A as described below. First, seal 617 is removed. As shown in FIG. 27, ink tank 2000 is then rotated by 90° so that first chamber 611 is above second chamber 612, thereby affording access to an open through hole 616A. The supply needle 4300 of injection device 4000 is inserted into compartment 611A via through hole 616A, and ink is thereafter injected into the tank. In a preferred embodiment, the tip of the supply needle 4300 is first positioned in the vicinity of communicating hole 610' and ink is injected into second chamber 612. Thereafter, supply needle 4300 is slightly retracted and ink is injected into ink absorbing member 615A, so that ink is effectively supplied to first and second chambers 611A and 612. The through hole 616A is then closed by seal 617. In an alternative embodiment, a rubber sheet having a large resilient recovering force may be used in place of seal 617. Supply needle 4300 would then pierce through the sheet and supply ink to the ink tank. Therefore, seal 617 would not need to be removed and replaced in through hole 616A.

If ink absorbing member 615A does not need to be replaced with a fresh ink absorbing member, ink may be supplied to replenish the ink tank via through hole 616A by using injection device 4000 while lid 630 remains closed on the top of container 601.

Figure 28:
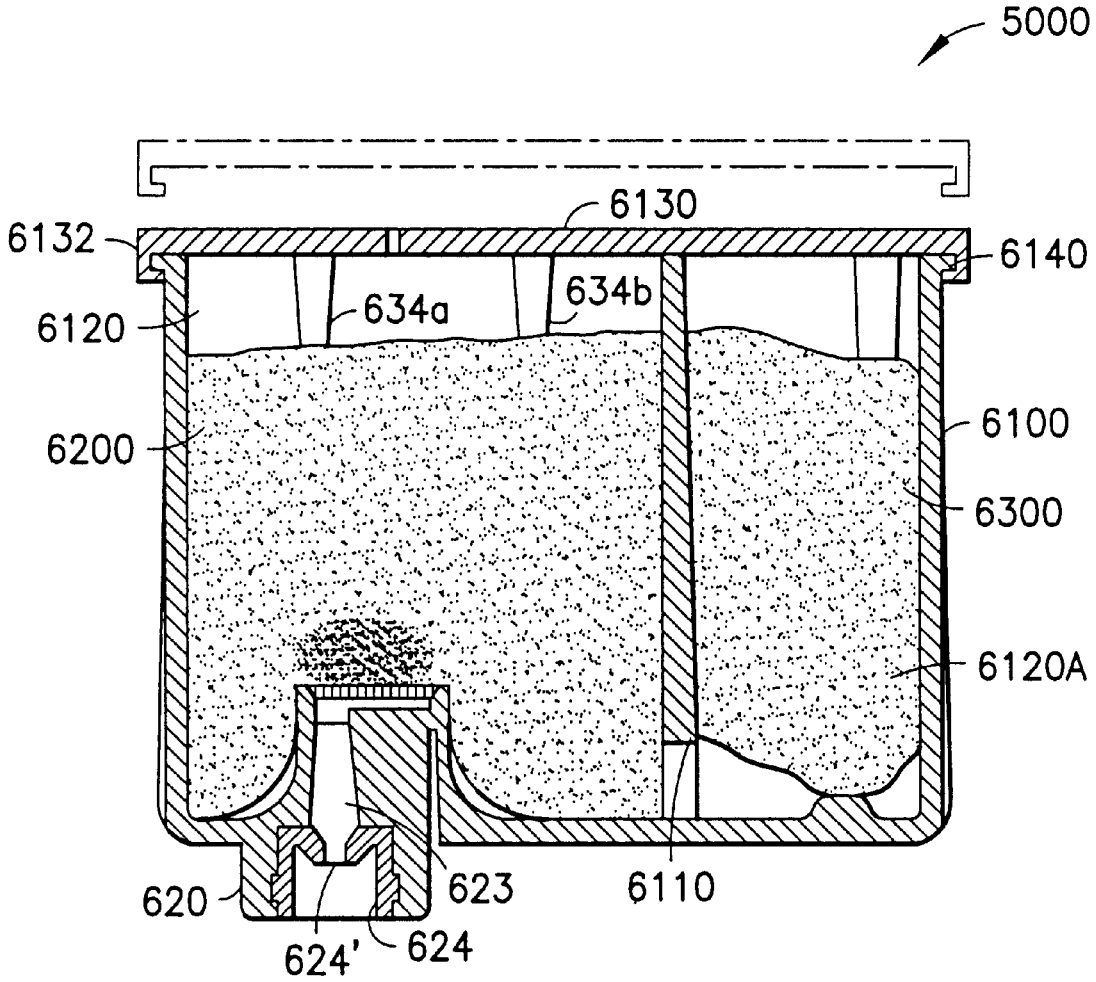
FIG. 28 is a cross-sectional view of an ink tank constructed in accordance with a third additional embodiment of the invention.
Figure 29A:
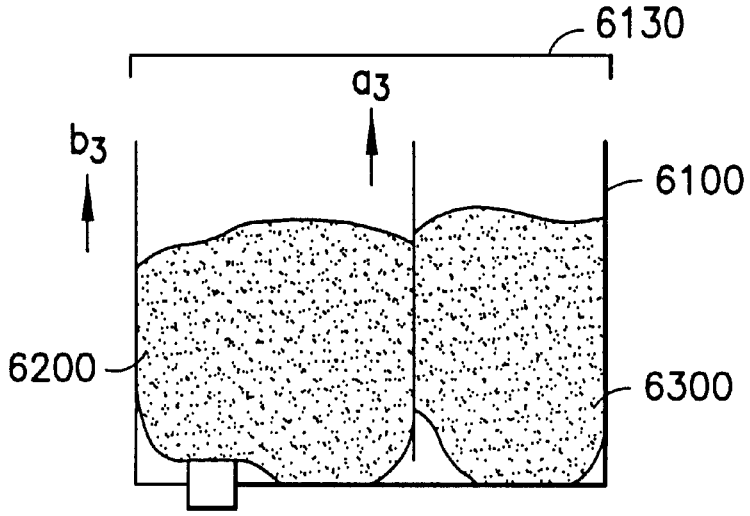
FIGS. 29(*a*) and 29(*b*) are schematic diagrams illustrating the steps of supplying ink to the ink tank of FIG. 28.
Figure 29B:
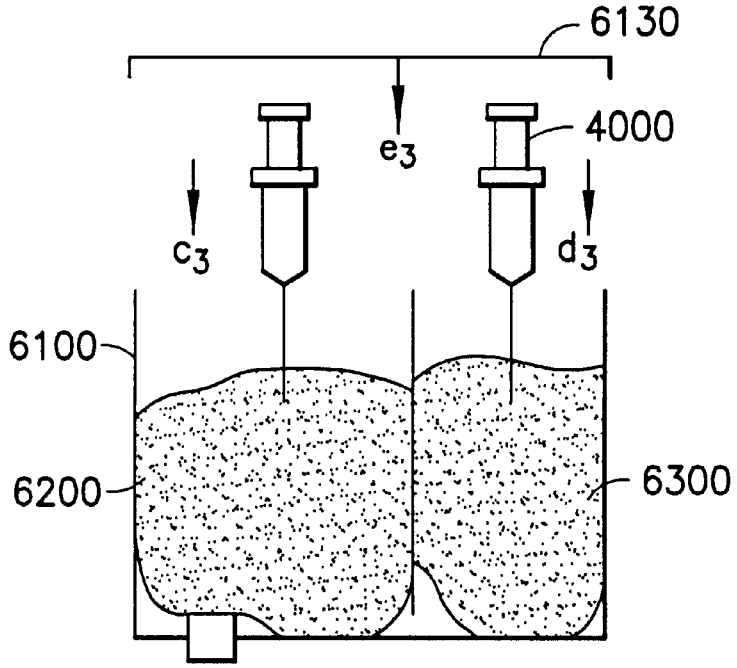

Reference is now made to FIGS. 28 and 29(*a*) and (*b*) which depict an ink tank 5000 constructed in accordance with a third additional embodiment of the invention. Like elements are given like reference numerals, and are not described here again.

A container 6100 is divided into first and second chambers 6120 and 6120A by a partition 6110 and chambers 6120 and 6120A house ink absorbing members 6200 and 6300, respectively. A lid 6130 is detachably fixed to the top opening of container 6100 so that first and second chambers 6120 and 6120A are opened at the same time. An engaging portion 6132 which is formed in the periphery of lid 6130 and directed inward is detachably engaged with a rib 6140 which is formed on container 6100 and directed outward.

To refill the ink tank, inward engaging portion 6132 is disengaged from outward rib 6140, and lid 6130 is removed from the top of container 6100 as shown in phantom. Depleted ink absorbing members 6200 and 6300 are extracted from first and second chambers 6120 and 6120A, and fresh ink absorbing members 6200 and 6300 are then loaded into chambers 6120 and 6120A respectively. If either of the depleted ink absorbing members 6200 or 6300 is not damaged and can be reused, then that ink absorbing member need not be replaced.

As in the first additional embodiment, the depleted ink tank 5000 may not have an ink absorbing member in second chamber 6120A. Also, during the refilling process ink absorbing member 6300 in second chamber 6120A may also be replaced, if necessary.

Next, refilling the ink tank shown in FIGS. 28 and 29 will be described.

In ink tank 5000 after the ink is depleted, inward engaging portion 6132 is disengaged from outward rib 6140, and lid 6130 is pulled up in the direction of arrow $a_3$ (FIG. 29(*a*)) so that lid 6130 is removed from container 6100. This movement of lid 6130 opens first and second chambers 6120 and 6120A of container 6100.

Ink absorbing members 6200 and 6300 are then extracted from first and second chambers 6120 and 6120A in the direction of arrow $b_3$ (FIG. 29(*a*)) if necessary. Fresh ink absorbing members 6200 and 6300 are then forcedly pushed into first and second chambers 6120 and 6120A in the direction of arrows $C_3$ and $d_3$ so as to be housed in chambers 6120 and 6120A under compression (FIG. 29(*b*)).

A sufficient amount of ink is thereafter injected into ink absorbing members 6200 and 6300 by using injection device 4000. Finally, lid 6130 is lowered in the direction of arrow $e_3$ so as to contact with the top opening of container 6100. Inward engaging portion 6132 is engaged with outward rib 6140, thereby sealing lid 6130 and completing the refilling process.

Figure 30:
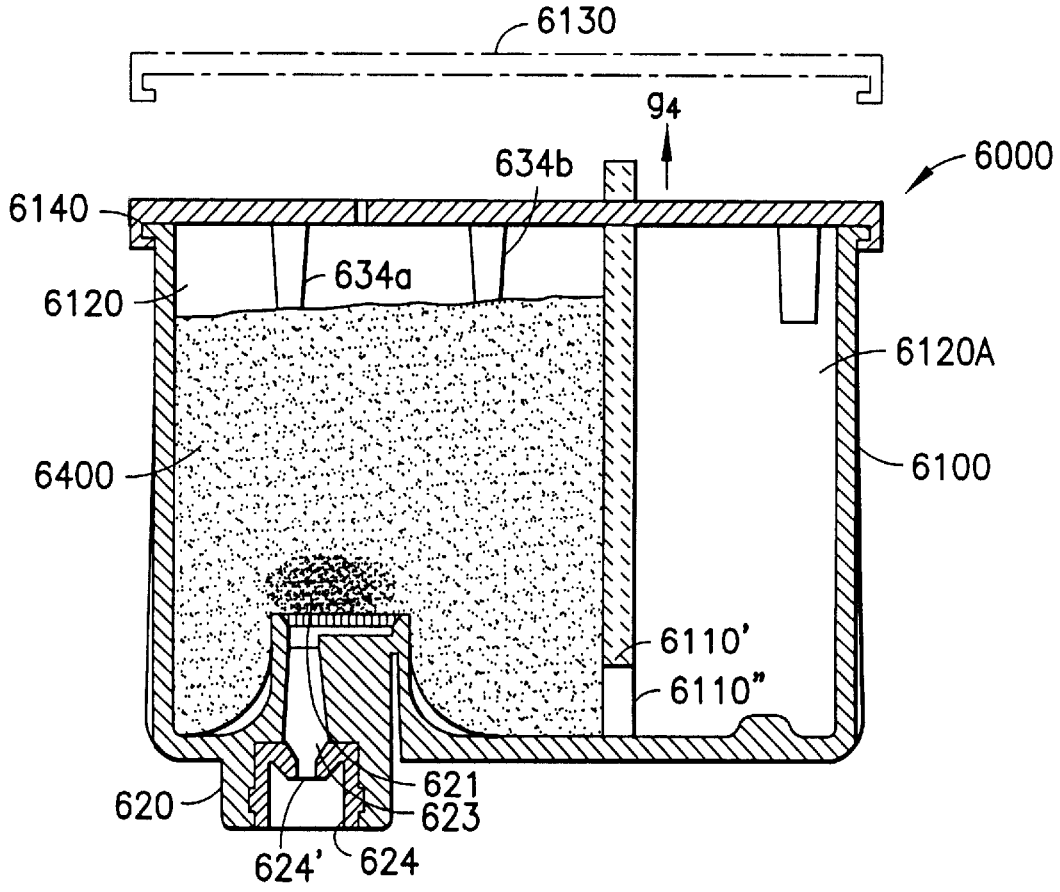
FIG. 30 is a cross-sectional view of an ink tank constructed in accordance with a fourth additional embodiment of the invention.
Figure 31:
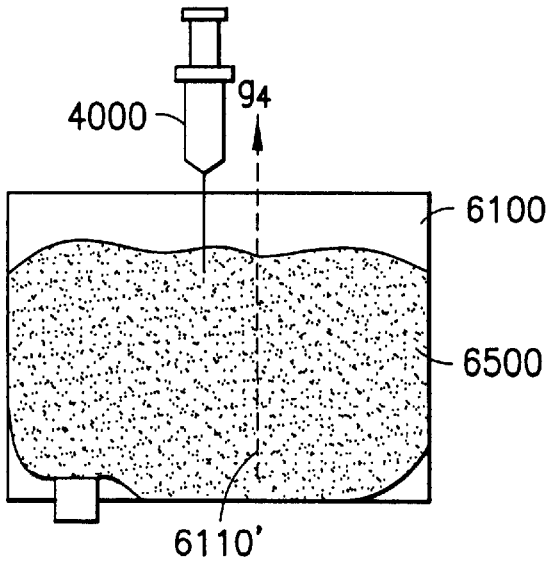
FIG. 31 is a schematic diagram illustrating the steps of supplying ink to the ink tank of FIG. 30.

Reference is now made to FIGS. 30 and 31 which depict an ink tank constructed in accordance with a fourth embodiment of the present invention. Like elements from previous embodiments being given like reference numerals, the primary difference being a removable partition for defining a single chamber. Ink tank 6000 includes a partition 6110' which separates a first chamber 6120 from a second chamber 6120A. Partition 6110' is detachably and slidably attached to container 6100 as indicated by the phantom line 6110". Partition 6110' can be removed to form a single chamber as a combination of chambers 6120 and 6120A.

As shown in FIG. 31, to refill the ink tank, after removing lid 6130, a depleted ink absorbing member 6400 is removed, and partition 6110' is also removed in the direction indicated by arrow $g_4$. Thereafter, an integrated ink absorbing member 6500 is loaded so as to fill container 6100. Ink is then injected into absorbing member 6500 by injection device 4000. Lid 6130 is then reattached.

Figure 32:
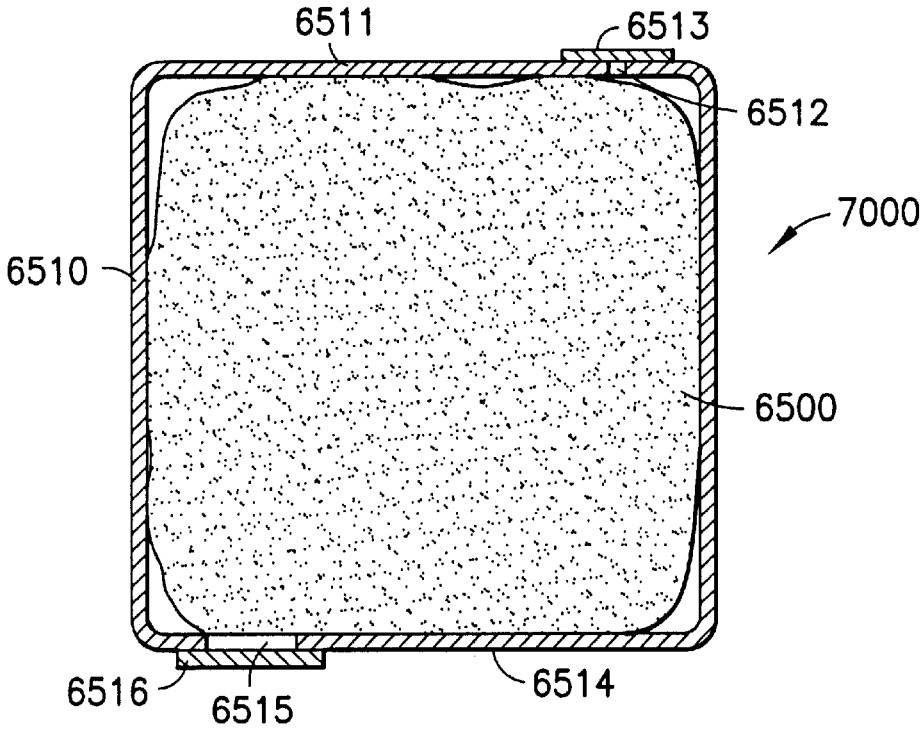
FIG. 32 is a cross-sectional view of an ink replenishment pack constructed in accordance with the invention.
Figure 33:
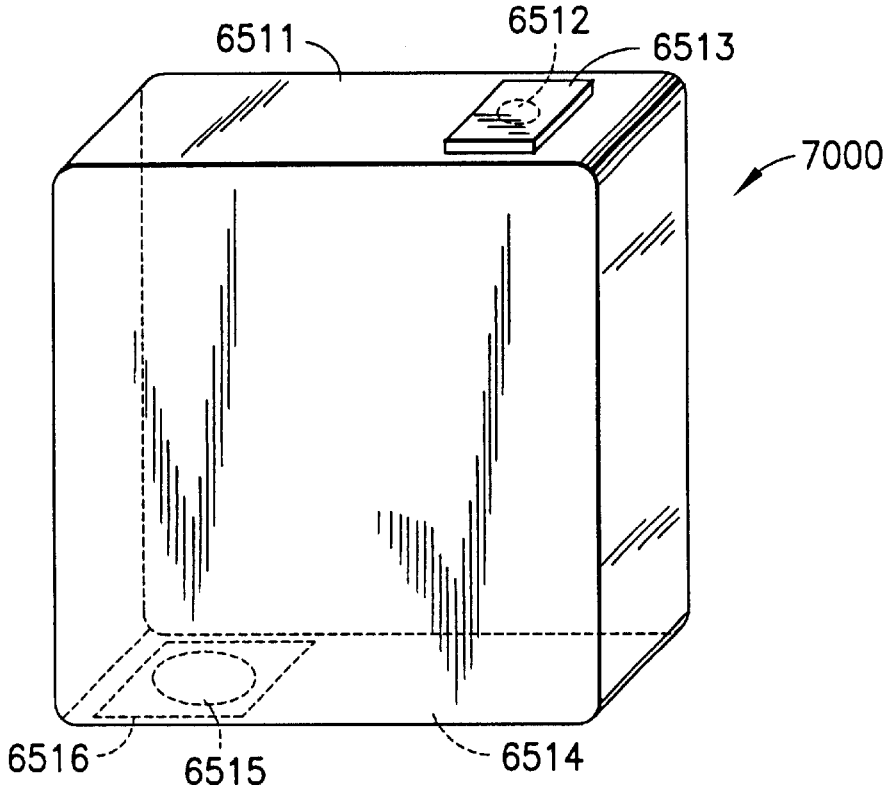
FIG. 33 is a perspective view depicting the ink replenishment pack of FIG. 32 showing the ink port in phantom.

Reference is now made to FIGS. 32 and 33 which depict a replenishment pack 7000 for use in conjunction with the ink tank of the fourth embodiment. Replenishment pack 7000 allows for clean handling of ink absorbing member 6500.

As shown FIGS. 32 and 33, replenishment pack 7000 includes a storage unit 6500 having at least a top wall 6511 and bottom wall 6514 and encloses an ink absorbing member 6500 impregnated with ink. Ink absorbing member 6500 has previously been compressed and is housed in cube-like hollow storage unit 6510, which is made of an air-impermeable material which is a lamination of thin plastic sheets or metallic foils by way of example. A through hole 6512 is formed in top wall 6511. Through hole 6512 can be opened by means of a releasable seal 6513. Similarly, a through hole 6515 is formed in a bottom wall 6514 and through hole 6515 can be opened by means of a releasable seal 6516.

Replenishment pack 7000 is employed in the following manner. Partition 6110' of ink cartridge 6000 is removed from container 6100, and releasable seals 6513 and 6516 are removed from the storage unit 6510. Storage unit 6510 is then loaded into container 6100 and is attached to ink supply port 620 to supply ink to the printer. Storage unit 6510 may be attached to ink supply port 620 by through hole 6515 formed in bottom wall 6514, and a filter 621 which is made of a flexible material such as plastic (for example, see the reference numeral 621 in FIG. 23) may be attached to the opening.

When compressing ink absorbing member 6500, the compression may be conducted on the whole of the member, or alternatively the compression may be conducted in a selective manner in the lateral directions or in the vertical directions.

A plural number of storage units 6510 may store a plurality of ink absorbing members 6500, respectively absorbing inks of different colors such as yellow, magenta, and cyan. The storage units may selectively be attached and detached in the respective compartments 611A, 611B, and 611C shown in FIG. 24.

Figure 34:
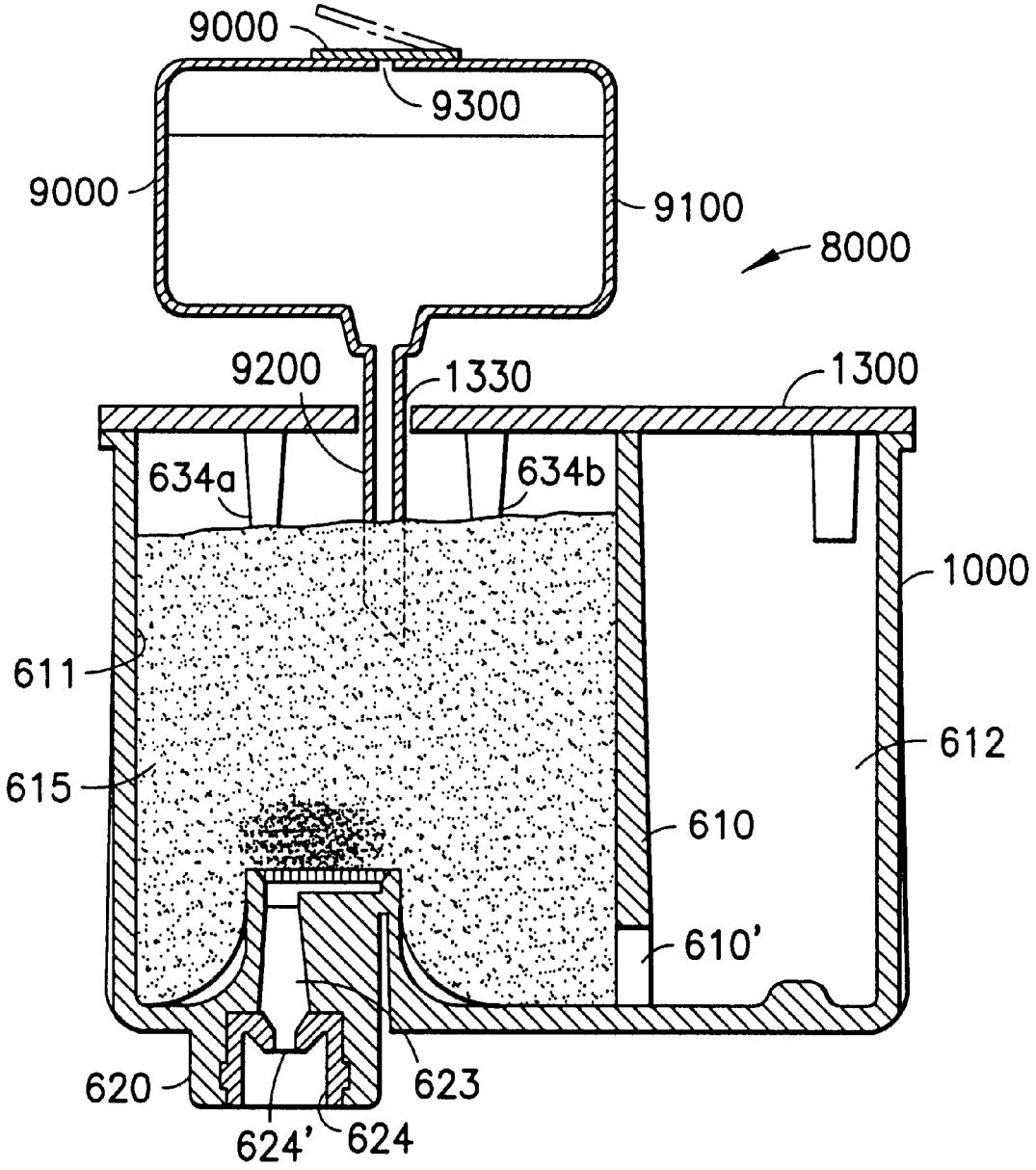
FIG. 34 is a cross-sectional view of an ink replenishment tool and an ink tank constructed in accordance with a fifth additional embodiment of the invention.

Reference is now made to FIG. 34 which depicts an ink tank 8000 and ink replenishment tool 9000 constructed in accordance with a fifth additional embodiment of the invention. Like elements from previous embodiments are indicated by reference numerals.

An ink tank 8000 has a lid 1300 fixed to a container 1000. Container 1000 is divided into a first chamber 611 and a second chamber 612 which communicate with each other through a communicating hole 610'. An ink absorbing member 615 is disposed in first chamber 611. An air vent hole 1330 is formed in lid 1300.

A replenishment tool 9000 shown in FIG. 34 is used to refill container 1000. Replenishment tool 9000 includes a tank 9100 coupled to a supply needle 9200. An air supply hole 9300 is formed in the top of a replenishment tank 9100 from which a supply needle 9200 extends vertically down. Air supply hole 9300 is closed by a releasable seal 9400. To replenish ink, supply needle 9200 pierces into an ink absorbing member 615 in a first chamber 611. Thereafter, releasable seal 9400 is removed as indicated by the phantom line in FIG. 34 which opens air supply hole 9300, and allows air into tank 9100. Thus, the air entering supply needle 9200 will allow ink to be released through supply needle 9200, into ink absorbing member 615. In order to allow air in the interior of ink absorbing member 615 to escape when ink is being refilled, in a preferred embodiment a small gap is formed between air vent hole 1330 and supply needle 9200 or another air vent hole is provided in another portion of the lid 1300.

When degassed ink is employed, ink can be supplied into container 1000 more effectively since while falling by gravity the ink will absorb any small air bubbles contained in ink absorbing member 615. Thus, ink can be supplied which will enhance the reliability of the recording head. In a preferred embodiment, an amount of ink which is approximately smaller than half of the capacity of the first chamber 611 should be supplied.

Figure 35:
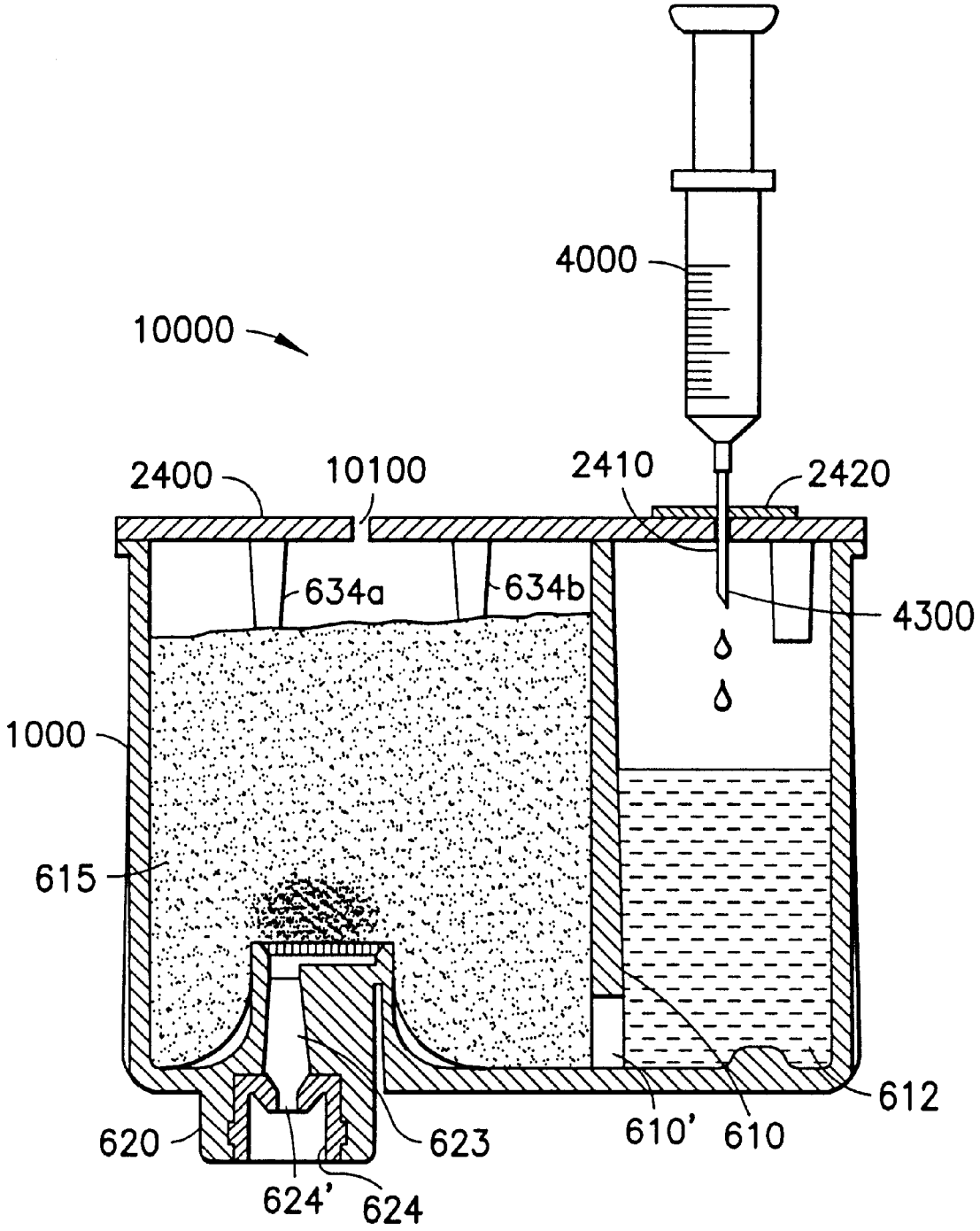
FIG. 35 is a cross-sectional view of an ink tank constructed and being replenished in accordance with a sixth additional embodiment of the invention.

Reference is now made to FIG. 35 which depicts an ink tank constructed in accordance with a sixth additional embodiment of the invention. Like elements from previous Embodiments are indicated by like reference numerals, the primary difference between this embodiment and ink tank 8000 being a replenishment hole in the lid over the second chamber.

An ink tank 10000 has a first chamber 611 of container 1000 which houses an ink absorbing member 615. In order to directly supply ink to a second chamber 612 which is adjacent first chamber 611 and does not house ink absorbing member 615, a replenishment hole 2410 is formed in a lid 2400 fixed to container 1000. Replenishment hole 2410 is selectively closed in an openable manner by a releasable seal 2420. When ink tank 10000 is to be refilled, replenishment hole 2410 is opened by removing releasable seal 2420. The seal 2420 may be formed of elastic rubber which has a large recovering ring so that the ink does not leak after the supply needle 4300 penetrates the seal 2420 to inject the ink into the chamber Thereafter, supply needle 4300 of injection device 4200 is passed through replenishment hole 2410 and ink is supplied to second chamber 612. In a preferred embodiment, it is preferable to form a small gap between replenishment hole 2410 and supply needle 4300 or form an air vent hole 10100 in a portion of lid 2400 of second chamber 612 to allow air to escape during replenishment.

In place of the releasable seal 2420, a rubber sheet having a large resilient recovering force may be used. Supply needle 4300 would then pierce through the rubber sheet as shown in FIG. 35 and ink would be supplied.

Figure 37:
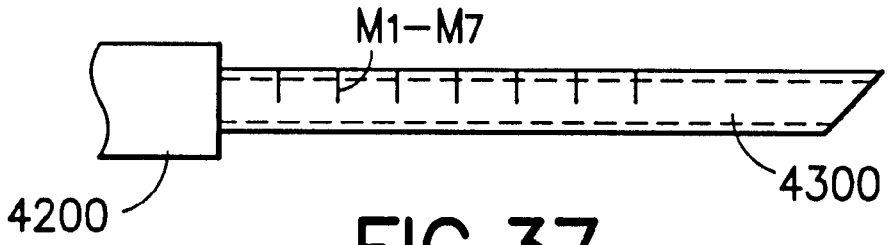
FIG. 37 is an enlarged fragmented side elevational view of a supply needle of the ink injection device of FIG. 36.

Reference is now made to FIGS. 36 and 37 which depict previously mentioned injection device 4000 which has a syringe-like shape. A scale 4200 is formed on the container portion 4100 of injection device 4000, and scales $M_1$ to $M_7$ are formed on supply needle 4300 along the longitudinal direction thereof as shown in FIG. 37. When using injection device 4200, the quantity of ink being supplied can be monitored by viewing the scale 4200. The depth that supply needle 4300 has been inserted into an ink absorbing member can be detected by means of the scales $M_1$ to $M_7$ so that ink is injected to the ink absorbing member at the desired depth. Therefore, ink can be absorbed effectively throughout the entire volume of the ink absorbing member. Preferably, the injection device 4000 is filled with ink which has been previously degassed, and is wrapped and stored in an air-impermeable material such as aluminum or an aluminum laminate before being used in the replenishment process. This improves print quality by removing any air bubbles which might remain in the ink absorbing member. As required, degassed ink is stored in a storage pack (not shown) which is made of a gas-impermeable material. A number of storage packs and an associated empty injection device 4000 may be supplied as an ink refill kit.

Figure 38:
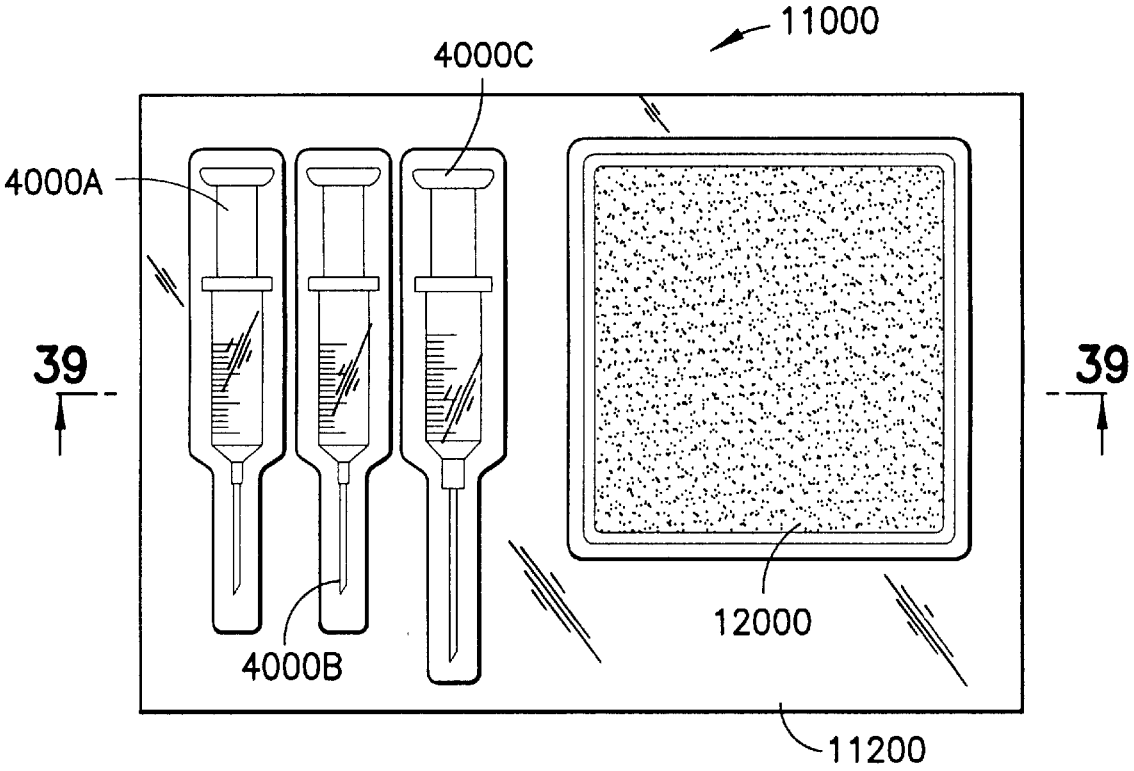
FIG. 38 is a top plan view of an ink replenishment set constructed in accordance with the invention.
Figure 39:
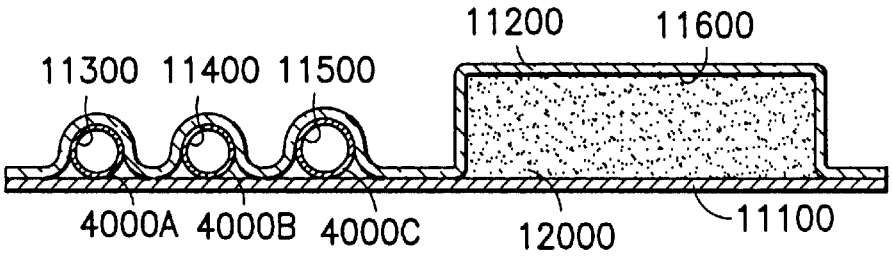
FIG. 39 is a cross-sectional view taken along line 39—39 of FIG. 38.

Reference is now made to FIGS. 38 and 39 which depict an ink replenishment set 11000 constructed in accordance with the invention. In ink replenishment set 11000, inks of different colors are respectively filled in each of a plurality of ink injection devices 4000A, 4000B, 4000C described in FIG. 36. The injection devices are arranged on a base plate 11100. An ink absorbing member 12000 may also be placed on base plate 11100. These components may be covered by a cover sheet 11200 having recesses 11300 to 11600 which correspond to the outer shapes of injection devices 4000 and ink absorbing member 12000, thereby constituting the ink replenishment set 11000. When the set is to be used, cover sheet 11200 is removed from base plate 11100, one of the injection devices 4000 and the ink absorbing member 12000 are taken out from the recess and are used to replenish ink.

Further, ink injection device 4000 containing ink and ink absorbing member 12000 may be separately packed in separate ink replenishment sets rather than packed in a single ink replenishment set. If the black ink tank and the color ink tanks have different volumes, a number of ink absorbing members may be provided, each corresponding to the volume of the associated ink tank. These different ink absorbing members may be provided in the same or different ink replenishment sets. The corresponding ink injection devices would also have an amount of ink sufficient to replenish the associated ink tank and ink absorbing member.

As shown above, the ink injection device may be provided with ink already contained therein. However, it is also possible to provide a storage pack with ink contained therein, and an empty ink injection device. These may be provided in the same or different replenishment sets. It is possible to provide any combination of ink, ink tanks, ink injection devices and ink absorbing members without departing from the spirit of the invention.

The invention as described above results in the following benefits:

(1) The ink tank can be reused.

Since ink or an ink absorbing member can easily be supplied to the chambers separated from each other by a partition in the container of the ink tank, the ink tank can be used over and over for a long time. Since the depleted ink tank is not required to be disposed of, moreover, the environment is prevented from being polluted. Therefore, the invention is highly effective.

(2) The ink replenishment process is conducted in a clean manner.

By opening the lid of the container of the ink tank, the ink absorbing member may be replenished with ink in a clean manner without staining anything outside the ink tank. Alternatively, since ink can be supplied by using the ink injection device or the ink replenishment tool without opening the lid of the container, the user is prevented from being soiled by the ink.

(3) The ink replenishment process is conducted efficiently.

A precise amount of ink can be supplied effectively to the chamber housing the ink absorbing member or ink, by using a replenishment pack, an injection device, or a replenishment set. Therefore, the efficiency of the replenishment work can be improved.

It will thus be seen that the objects set forth above, among those made apparent from the preceding description are efficiently attained and, since certain changes may be made in carrying out the above construction and method set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

What is claimed is:

1. An ink replenishment pack for use with an ink tank cartridge for an ink-jet recording apparatus, said ink replenishment pack being shaped and dimensioned to be loaded into the ink tank cartridge, the ink replenishment pack comprising:

a housing formed of a flexible film-like member, said housing having a top wall and a bottom wall and being formed with a first selectively openable through hole in said top wall and a second selectively openable through hole in said bottom wall; and an ink absorbing member containing ink, said ink absorbing member being retained in said housing in a compressed state before said housing and said ink absorbing member retained therein are positioned into the ink tank cartridge;

said flexible film-like member being a laminate comprising metallic foils made of an air-impermeable material.

2. An ink replenishment pack for use with an ink tank cartridge for an ink-jet recording apparatus, said ink replenishment pack being shaped and dimensioned to be loaded into the ink tank cartridge, the ink replenishment pack comprising:

a housing having a top wall and a bottom wall, said housing being formed with a first selectively openable through hole in said top wall and a second selectively openable through hole in said bottom wall;

an ink absorbing member containing ink, said ink absorbing member being retained in said housing in a compressed state before said housing and said ink absorbing member retained therein are positioned into the ink tank cartridge; and a first releasable seal for sealing said first selectively openable through hole and a second releasable seal for sealing said second selectively openable through hole.

3. An ink replenishment pack for use with an ink tank cartridge for an ink-jet recording apparatus, said ink replenishment pack being shaped and dimensioned to be loaded into the ink tank cartridge, the ink replenishment pack comprising:

a housing formed of a flexible film-like member, said housing having a top wall and a bottom wall and being formed with a first selectively openable through hole in said top wall and a second selectively openable through hole in said bottom wall; and an ink absorbing member containing ink, said ink absorbing member being retained in said housing in a compressed state, said housing, when filled with said ink absorbing member, being dimensioned for positioning in the ink tank cartridge;

said flexible film-like member being a laminate comprising thin plastic sheets made of an air-impermeable material.

* * * * *